US010459361B2

(12) United States Patent
Saito et al.

(10) Patent No.: US 10,459,361 B2
(45) Date of Patent: Oct. 29, 2019

(54) IMAGE FORMING APPARATUS WITH VOLTAGE ADJUSTMENT MEMBER

(71) Applicant: CANON KABUSHIKI KAISHA, Tokyo (JP)

(72) Inventors: Seiji Saito, Mishima (JP); Keisuke Ishizumi, Hiratsuka (JP); Toshihiko Takayama, Kawasaki (JP); Masaru Ohno, Ebina (JP); Shingo Ito, Tokyo (JP); Shohei Ishio, Tokyo (JP); Keisuke Samejima, Suntou-gun (JP); Keizo Kojima, Yokohama (JP); Ryo Matsumura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 164 days.

(21) Appl. No.: 15/662,832

(22) Filed: Jul. 28, 2017

(65) Prior Publication Data

US 2018/0039198 A1 Feb. 8, 2018

(30) Foreign Application Priority Data

Aug. 4, 2016 (JP) ..... 2016-153769
Feb. 15, 2017 (JP) ..... 2017-026151

(51) Int. Cl.
*G03G 15/16* (2006.01)
*G03G 15/01* (2006.01)
(Continued)

(52) U.S. Cl.
CPC ..... *G03G 15/0194* (2013.01); *G03G 15/0121* (2013.01); *G03G 15/0189* (2013.01);
(Continued)

(58) Field of Classification Search
CPC ..... G03G 15/0194; G03G 15/1675; G03G 15/1645; G03G 21/168
(Continued)

(56) References Cited

U.S. PATENT DOCUMENTS 9,002,227 B2 4/2015 Ohno et al.
9,195,174 B2 11/2015 Kobayashi et al.
(Continued)

FOREIGN PATENT DOCUMENTS

JP 2013-213990 A 10/2013

OTHER PUBLICATIONS

U.S. Appl. No. 15/664,239, Keisuke Ishizumi, Seiji Saito, Toshihiko Takayama, Masaru Ohno, Shingo Ito, Shohei Ishio, filed Jul. 31, 2017.

*Primary Examiner* — William J Royer
(74) *Attorney, Agent, or Firm* — Venable LLP

(57) ABSTRACT

An image forming apparatus includes a voltage adjustment portion having a voltage adjustment member connected to a contact member contacting an endless belt, the voltage adjustment portion changing a current flowing from a current supply member contacting the belt at a position different from a position, at which an image bearing member contacts the belt with respect to a rotating direction of the belt, to the voltage adjustment member via the belt according to a control signal input from a control portion outputting a control signal, thereby changing a size of a transfer potential to transfer a toner image borne by the image bearing member onto the belt at a part at which the belt contacts the image bearing member.

24 Claims, 17 Drawing Sheets

(51) Int. Cl.
*G03G 21/16* (2006.01)
*G03G 15/00* (2006.01)

(52) U.S. Cl.
CPC ..... *G03G 15/1615* (2013.01); *G03G 15/1675* (2013.01); *G03G 21/168* (2013.01); *G03G 21/1652* (2013.01); *G03G 15/80* (2013.01)

(58) Field of Classification Search
USPC ..... 399/24, 66, 302
See application file for complete search history.

(56) References Cited

U.S. PATENT DOCUMENTS

| | | | | |
|---|---|---|---|---|
| 9,454,108 | B2 | 9/2016 | Katagiri et al. | |
| 10,197,940 | B2 * | 2/2019 | Ito et al. ..... | G03G 15/1675 |

* cited by examiner

IMAGE FORMING APPARATUS WITH VOLTAGE ADJUSTMENT MEMBER

BACKGROUND OF THE INVENTION

Field of the Invention

The present invention relates to an image forming apparatus using an electrophotographic system.

Description of the Related Art

Conventionally, there has been known an image forming apparatus such as a copier and a laser beam printer configured to use an endless belt as an intermediate transfer member. In the image forming apparatus, a toner image formed on the surface of a photosensitive drum serving as an image bearing member is transferred onto a belt as a primary transfer step when a voltage is applied from a voltage power supply to a primary transfer member arranged at a part opposing the photosensitive drum. Then, the primary transfer step is repeatedly performed with respect to toner images of a plurality of colors to form the toner images of the plurality of colors on the surface of the belt. Subsequently, the toner images of the plurality of colors formed on the surface of the belt are collectively transferred onto the surface of a recording material such as a paper as a secondary transfer step when a voltage is applied to a secondary transfer member. After that, the collectively transferred toner images are permanently fixed onto the recording material by a fixing unit. In the way described above, a color image is formed.

Japanese Patent Application Laid-open No. 2013-213990 discloses a configuration allowing a change in the surface potential of a belt while making it possible to perform the miniaturization and the cost reduction of an image forming apparatus. According to the configuration, circuits having a plurality of Zener diodes different in setting voltage are provided between the belt and ground, and the setting voltage is changed according to a use environment to change the surface potential of the belt and stabilize primary transfer efficiency.

SUMMARY OF THE INVENTION

Generally, a plurality of members such as a photosensitive drum, an intermediate transfer member, and a primary transfer member are interposed as the configuration of a primary transfer portion, and there is a case that the resistance of the primary transfer portion changes or a case that an optimum primary transfer current changes depending on a surrounding environment or the use situation of an image forming apparatus. In the configuration of Japanese Patent Application Laid-open No. 2013-213990, a surrounding environment is detected and the surface potential of a photosensitive drum is slightly adjusted with a change in a voltage maintaining unit to ensure optimum transferability. However, in the slight adjustment of the surface potential of the photosensitive drum, each of a developing potential and a primary transfer potential has a potential difference necessary for properly moving toner. Therefore, when the surface potential of the photosensitive drum is largely changed to be adjusted, a reduction in image quality is caused. That is, in order to slightly adjust various fluctuations caused by a surrounding environment or the use situation of the body of the image forming apparatus, it is necessary to further increase the number of Zener diodes serving as the voltage maintaining unit, which results in a difficulty in maintaining the miniaturization of the apparatus.

It is an object of the present invention to provide an image forming apparatus capable of making the surface of an intermediate transfer member have an optimum potential for primary transfer while maintaining the miniaturization of the image forming apparatus.

In order to achieve the above object, an embodiment of the present invention provides an image forming apparatus comprising:

an image bearing member that bears a toner image;

an endless belt that rotates in contact with the image bearing member;

a current supply member that contacts the belt at a position different from a position, at which the image bearing member contacts the belt with respect to a rotating direction of the belt, and supplies a current to the belt;

a control portion that outputs a control signal;

a contact member that contacts the belt; and a voltage adjustment portion that has a voltage adjustment member connected to the contact member and that changes an amount of the current flowing from the current supply member to the voltage adjustment member via the belt according to the control signal input from the control portion, thereby changing a magnitude of a transfer potential at a part, at which the belt contacts the image bearing member.

According to an embodiment of the present invention, it is possible to make the surface of an intermediate transfer member have an optimum potential for primary transfer while maintaining miniaturization.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

First Embodiment

Figure 1:
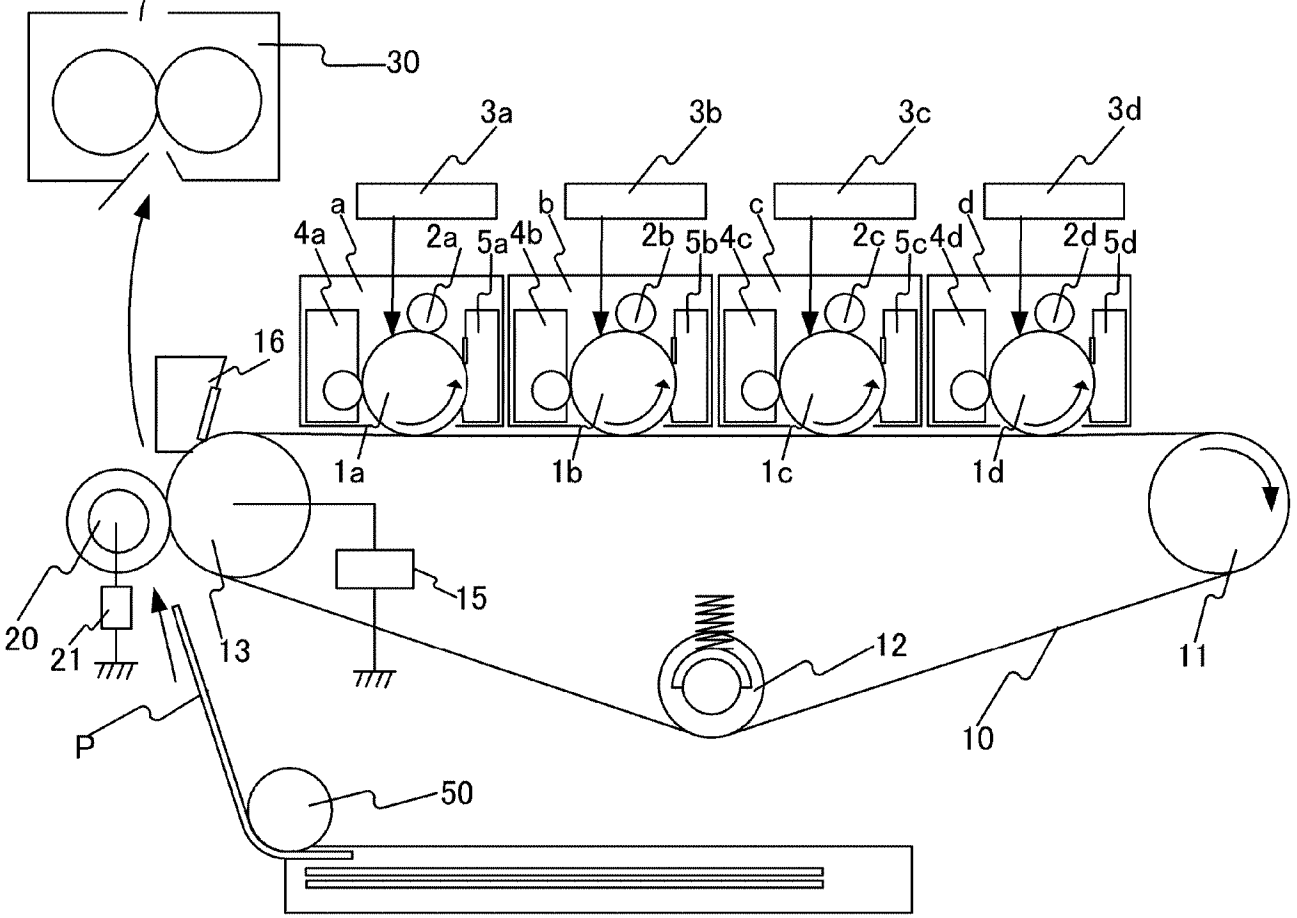
FIG. 1 is a diagram for describing an image forming apparatus according to a first embodiment.

FIG. 1 is a schematic diagram of an image forming apparatus according to a first embodiment of the present invention. A description will be given, with reference to FIG. 1, of the configurations and the operations of the image forming apparatus of the embodiment. Examples of an image forming apparatus to which the present invention is applicable include a copier and a printer using an electrophotographic system. Here, a case in which the present invention is applied to a color laser printer will be described. Note that the image forming apparatus of the embodiment is a so-called tandem type printer having a plurality of image forming stations a to d. A first image forming station a forms an image of yellow (Y), a second image forming station b forms an image of magenta (M), a third image forming station c forms an image of cyan (C), and a fourth image forming station d forms an image of black (Bk). The configurations of the respective image forming stations are the same except for the colors of accommodated toner. Hereinafter, the first image forming station a will be described.

The first image forming station a has a drum-shaped electrophotographic photosensitive member (hereinafter called a photosensitive drum) 1*a* serving as an image bearing member, a charging roller 2*a* serving as a charging member, a developing device 4*a*, and a cleaning device 5*a*. The photosensitive drum 1*a* is an image bearing member that is rotationally driven in an arrow direction at a prescribed peripheral speed (process speed) and bears a toner image (developer image). In addition, the developing device 4*a* is a device that accommodates yellow toner serving as developer and develops an electrostatic latent image formed on the photosensitive drum 1*a* using the yellow toner. The cleaning device 5*a* is a member that collects the toner attached onto the photosensitive drum 1*a*. In the embodiment, the cleaning device 5*a* has a cleaning blade serving as a cleaning member that contacts the photosensitive drum 1*a* and a waste toner box that accommodates the toner collected by the cleaning blade.

When an image forming operation starts with an image signal, the photosensitive drum 1*a* is rotationally driven. In a rotation process, the photosensitive drum 1*a* is uniformly charged by the charging roller 2*a* to have a prescribed polarity (negative polarity in the embodiment) and a prescribed potential and then exposed by exposure unit 3*a* according to the image signal. Thus, an electrostatic latent image corresponding to a yellow component image of an objective color image is formed. Then, the electrostatic latent image is developed by the developing device (yellow developing device) 4*a* at a developing position and visualized as a yellow toner image. Here, the normal charging polarity of the toner accommodated in the developing device 4*a* is negative.

An intermediate transfer belt 10 is an endless belt. The intermediate transfer belt 10 is extended between extending members 11, 12, and 13 serving as support members and rotationally driven at substantially the same peripheral speed while contacting the photosensitive drum 1*a* in the same movement direction as the photosensitive drum 1*a* at its opposing part contacting the photosensitive drum 1*a*. The yellow toner image formed on the photosensitive drum 1*a* is transferred onto the intermediate transfer belt 10 (primary transfer) when passing through the contact part (hereinafter called the primary transfer nip) between the photosensitive drum 1*a* and the intermediate transfer belt 10. The method of the primary transfer characterizing the embodiment will be described later. The untransferred toner of the primary transfer on the surface of the photosensitive drum 1*a* is cleaned and removed by the cleaning device 5*a* and then subjected to an image forming process following a charging process. In the same way as the above, a magenta toner image of a second color is formed by the second image forming station b (including a photosensitive drum 1*b*, a charging roller 2*b*, a developing device 4*b*, and a cleaning device 5*b*), a cyan toner image of a third color is formed by the third image forming station c (including a photosensitive drum 1*c*, a charging roller 2*c*, a developing device 4*c*, and a cleaning device 5*c*), and a black toner image of a fourth color is formed by the fourth image forming station d (including a photosensitive drum 1*d*, a charging roller 2*d*, a developing device 4*d*, and a cleaning device 5*d*), respectively, and successively transferred onto the intermediate transfer belt 10 in an overlapped state. Prior to transfer, the charged photosensitive drums 1*b*-1*d* are exposed by exposure units 3*b*-3*d*, respectively. Thus, a combined color image corresponding an objective color image is obtained.

The toner images of the four colors on the intermediate transfer belt 10 are collectively transferred onto the surface of a recording material P fed by paper feeding unit (secondary transfer) when passing through a secondary transfer nip formed by the intermediate transfer belt 10 and a secondary transfer roller 20. The secondary transfer roller 20 serving as a secondary transfer member has an outer diameter of 18 mm in which a nickel-plated steel rod having an outer diameter of 8 mm is covered with a blowing sponge body mainly composed of NBR adjusted to have a volume resistance of $10^8$ Ω·cm and a thickness of 5 mm and epichlorohydrin rubber. In addition, the secondary transfer roller 20 contacts the intermediate transfer belt 10 with an applied pressure of 50 N and forms a secondary transfer part (hereinafter called the secondary transfer nip). The secondary transfer roller 20 rotates following the intermediate transfer belt 10. When the toner on the intermediate transfer belt 10 is being secondarily transferred onto the recording material P such as a paper, a voltage of 1800 to 2300 V is applied to the secondary transfer roller 20. The recording material P bearing the toner images of the four colors is introduced into a fixation unit 30 to be heated and pressed. Thus, the toner of the four colors is melted and mixed together and fixed onto the recording material P. Untransferred toner on the intermediate transfer belt 10 after the secondary transfer is cleaned and removed by a cleaning device 16. By the above operations, a full-color print image is formed.

Figure 2:
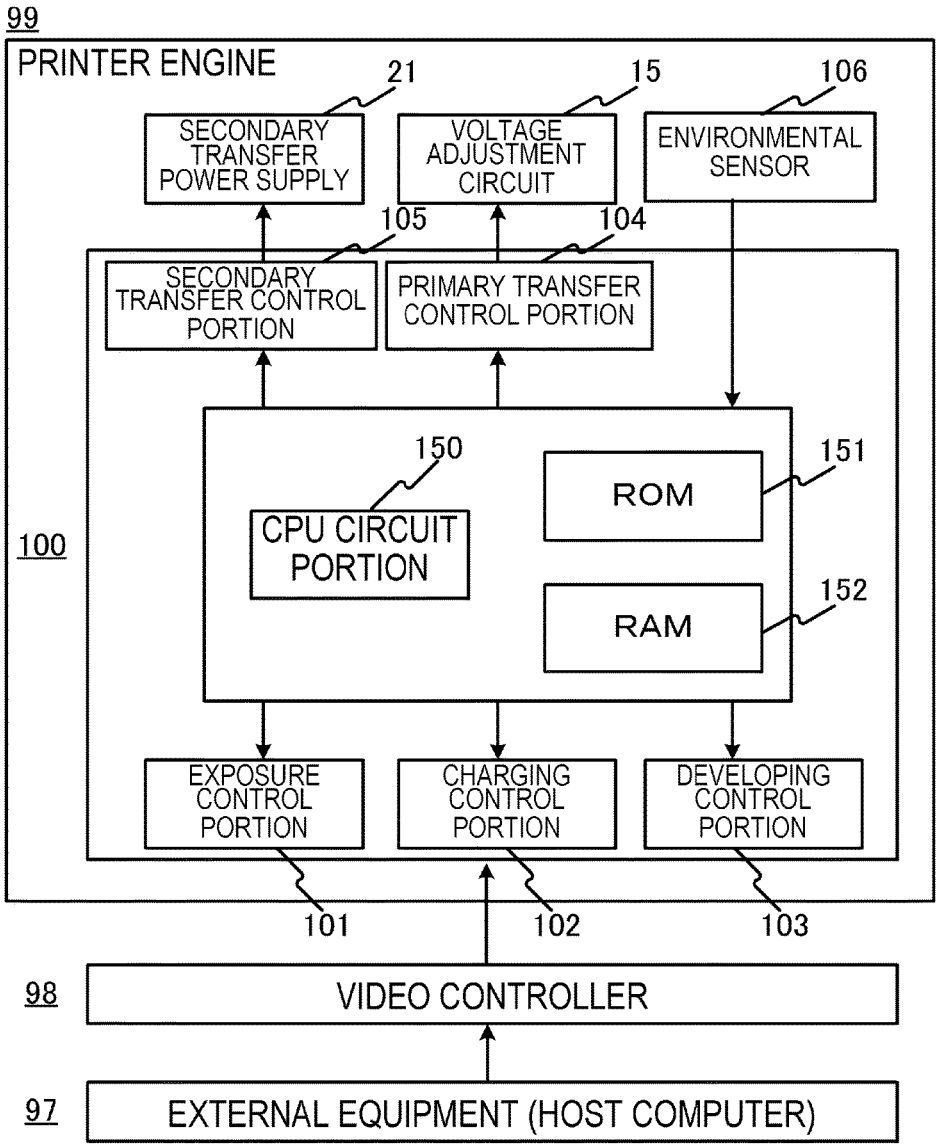
FIG. 2 is a block diagram for describing a controller relating to an image forming operation according to the first embodiment.

A description will be given, with reference to FIG. 2, of the configuration of a controller 100 that controls the body of the image forming apparatus of the embodiment. As shown in FIG. 2, the controller 100 has a CPU circuit portion 150 serving as a control portion. The CPU circuit portion 150 includes a ROM 151 and a RAM 152. The CPU circuit portion 150 totally controls an exposure control portion 101, a charging control portion 102, a developing control portion 103, a primary transfer control portion 104, and a secondary transfer control portion 105 according to a control program stored in the ROM 151. In addition, an environmental table and various tables for transfer control are stored in the ROM 151 and called and reflected by a CPU based on information on an environmental sensor 106 serving as a detection unit for detecting temperature and humidity in an apparatus setting environment. The RAM 152 temporarily retains control data and serves as a work area for calculation processing associated with control. The secondary transfer control portion 105 controls a secondary transfer power supply 21 and controls a voltage to be output from the secondary transfer power supply 21 based on a current value detected by a current detection circuit (not shown). In addition, the primary transfer control portion 104 transmits a signal to a voltage adjustment circuit 15 to control the potential of the primary transfer portion at a constant value. By the controller 100, the secondary transfer power supply 21, the voltage adjustment circuit 15, and the environmental sensor 106, a printer engine 99 of the image forming apparatus according to the embodiment is configured. When image information and a printing instruction are transmitted from a host computer 97, the controller 100 receives respective image signals converted by a video controller 98. Then, the controller 100 controls the respective control portions (the exposure control portion 101, the charging control portion 102, and the developing control portion 103) to perform an image forming operation necessary for a printing operation.

Hereinafter, a description will be given of the configuration of the primary transfer portion characterizing the embodiment. The embodiment is characterized by a configuration in which a current is supplied in the peripheral direction of the intermediate transfer belt 10 to perform the primary transfer, i.e., a configuration in which a primary transfer current is supplied at a position different from the primary transfer nips of the photosensitive drums 1*a*, 1*b*, 1*c*, and 1*d* in the peripheral direction (rotating direction) of the intermediate transfer belt 10. The intermediate transfer belt 10 and the photosensitive drums 1*a* to 1*d* form the contact parts (primary transfer nips) with the extension of the intermediate transfer belt 10 by the extending members 11 and 13 and are connected to the voltage adjustment circuit 15 including a transistor serving as a voltage adjustment member connected to the extending member 13. At its positions opposing the respective image forming stations a to d, the intermediate transfer belt 10 serving as an intermediate transfer member is arranged. The intermediate transfer belt 10 is an endless belt in which a conducting agent is added to a resin material to have conductivity. The intermediate transfer belt 10 is extended by the three shafts of the extending member (driving roller) 11, the extending member (tension roller) 12, and the extending member (secondary transfer opposing roller) 13 and extended by the tension roller 12 at a total pressure of 60 N. The intermediate transfer belt 10 is rotationally driven at substantially the same peripheral speed as those of the photosensitive drums 1*a* to 1*d* in the same movement direction at its opposing parts contacting the photosensitive drums 1*a* to 1*d*.

In addition, the secondary transfer opposing roller 13 serving as a contact member is connected to the voltage adjustment circuit 15 including a transistor as a voltage adjustment unit (voltage adjustment portion). The intermediate transfer belt 10 used in the embodiment has a peripheral length of 700 mm and a thickness of 90 μm. The intermediate transfer belt 10 is made of an endless polyethylene terephthalate (PET) resin molded by mixing an ion-based conducting agent as a conducting agent. As its electrical characteristics, the intermediate transfer belt 10 is characterized in that the unevenness or the like of a resistance value in the peripheral direction is fine although the resistance value fluctuates with respect to temperature and humidity in an atmosphere since the intermediate transfer belt 10 exhibits ion conducting characteristics and electrical conductivity is obtained when ions are transmitted between high polymer chains. In the embodiment, a current is supplied in the movement direction of the intermediate transfer belt 10 to perform the transfer. Therefore, a voltage drop becomes large when the resistance of the intermediate transfer belt 10 is high. As a result, the intermediate transfer belt 10 preferably has a low resistance layer since there is a likelihood of its primary transferability being impaired. In the embodiment, a base layer having a volume resistivity of $1\times10^8$ Ω·cm or less as a resistance was used to suppress a voltage drop in the intermediate transfer belt 10. For the measurement of the volume resistivity, the type UR (MCP-HTP12) of a ring probe is used in Hiresta-UP (MCP-HT450) manufactured by Mitsubishi Chemical Corporation. In the measurement of the volume resistivity, room temperature was set at 23° C. and room humidity was set at 50%. In addition, a voltage of 100 V was applied for 10 seconds. Further, in the embodiment, the intermediate transfer belt 10 is configured by two layers. By the arrangement of a high resistance layer on its surface, the intermediate transfer belt 10 suppresses a current flowing through a non-image part to further increase its transferability. However, the intermediate transfer belt 10 is not limited to this configuration but may be configured by a single layer or three or more layers.

In addition, the intermediate transfer belt 10 is made of a polyethylene terephthalate resin in the embodiment but may be made of other materials. Examples of the other materials include polyester, polycarbonate, polyarylate, and acrylonitrile-butadiene-styrene copolymer (ABS). Besides, examples of the other materials include polyphenylene sulfide (PPS), polyvinylidene difluoride (PVdF), and polyethylene naphthalate (PEN). These materials and the mixed resins of these materials may be used as the material of the intermediate transfer belt 10.

In the embodiment, the voltage adjustment circuit 15 having a transistor is connected as the voltage adjustment portion between the secondary transfer opposing roller 13 and ground. The voltage adjustment circuit 15 adjusts a voltage to be applied from the secondary transfer power supply 21 to the intermediate transfer belt 10 via the secondary transfer roller 20 to generate a primary transfer voltage for performing the primary transfer to move the toner on the respective photosensitive drum 1*a* to 1*d* onto the intermediate transfer belt 10. By the application of the primary transfer voltage adjusted by the voltage adjustment circuit 15 to a desired size, the surface potential of the intermediate transfer belt 10 becomes a desired primary transfer potential. Based on the potential differences (transfer contrast) between the surface potential of the intermediate transfer belt 10 and the surface potentials of the respective photosensitive drums 1*a* to 1*d*, the primary transfer is performed. A description will be given, with reference to FIG. 3, of the details of the voltage adjustment by the voltage adjustment circuit 15.

Figure 3:
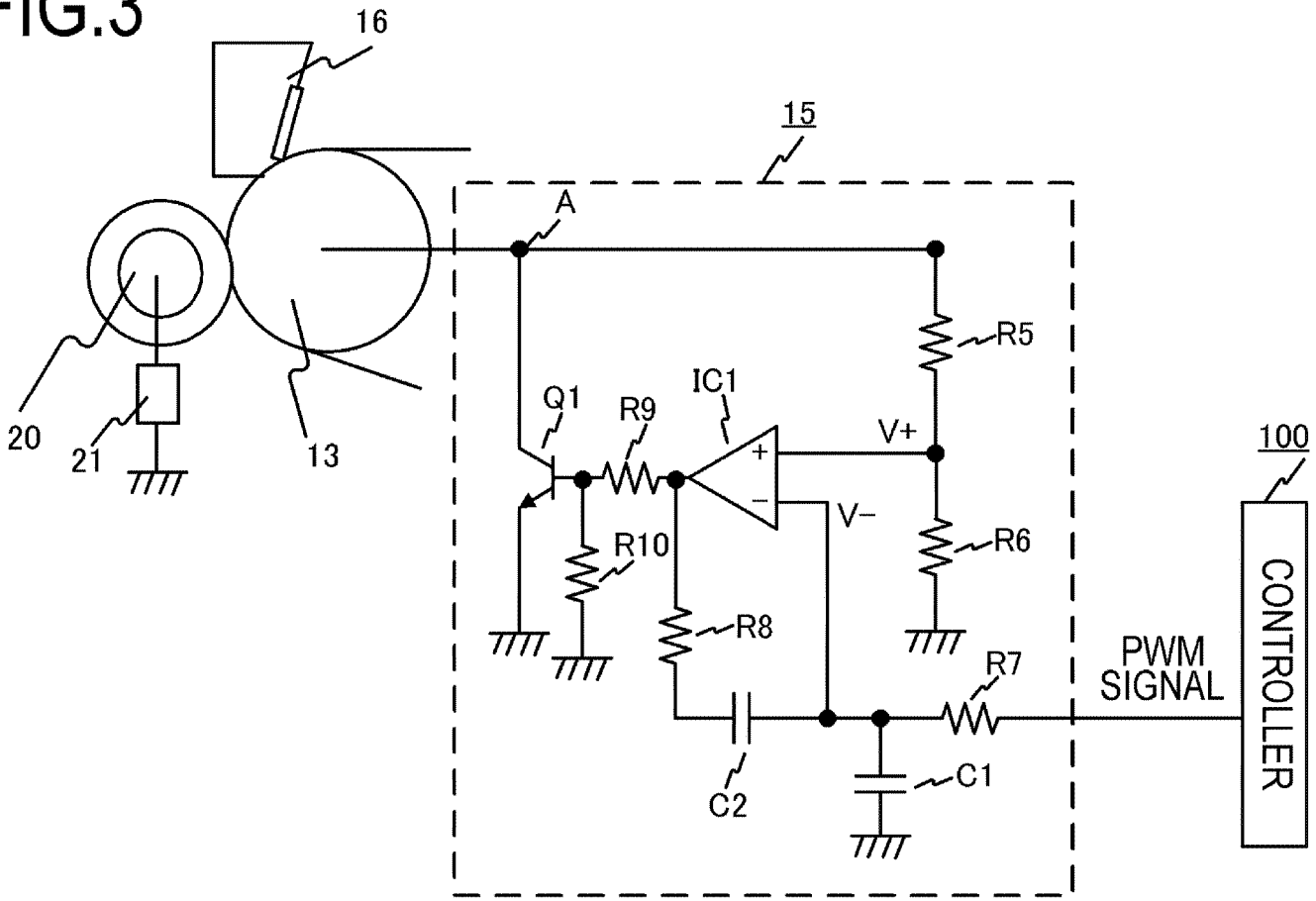
FIG. 3 is a diagram for describing a circuit of a primary transfer portion in the first embodiment.

FIG. 3 is a diagram for describing the circuit configuration of the primary transfer portion in the first embodiment of the present invention. When a secondary transfer voltage Vt2 (here 2100 V) is output from the secondary transfer power supply 21, a current flows from the secondary transfer power supply 21 to the voltage adjustment circuit 15 via the secondary transfer roller 20, the intermediate transfer belt 10, and the secondary transfer opposing roller 13. The voltage adjustment circuit 15 is electrically connected to the intermediate transfer belt 10 via the secondary transfer opposing roller 13, while a PWM signal is input from the controller 100 serving as a control portion to the voltage adjustment circuit 15. The voltage adjustment circuit 15 is configured to be capable of changing the amount of the current flowing from the secondary transfer roller 20 serving as a current supply member to the intermediate transfer belt 10 according to the size of the PWM signal input from the controller 100, i.e., the size of an on-duty ratio. That is, when the controller 100 controls the on-duty ratio of the PWM signal, the amount of the current flowing from the secondary transfer roller 20 to the intermediate transfer belt 10 is controlled and a primary transfer voltage Vt1 (potential difference between a point A and the ground in FIG. 3) formed by the current is controlled.

The primary transfer voltage Vt1 indicating the potential difference between the point A and the ground in FIG. 3 is the potential difference between (the surface of) the secondary transfer opposing roller 13 connected to the voltage adjustment circuit 15 and the ground and corresponds to the collector-emitter voltage of a transistor Q1 in the voltage adjustment circuit 15. Further, the surface potential of the intermediate transfer belt 10 wound on the surface of the secondary transfer opposing roller 13 becomes substantially the same as the surface potential of the secondary transfer opposing roller 13. The collector-emitter voltage of the transistor Q1 is controlled when the collector current of the transistor Q1 is controlled. That is, the primary transfer voltage Vt1, i.e., the surface potential of the intermediate transfer belt 10, is controlled by the control of the collector current. A current generated by the application of the secondary transfer voltage Vt2 flows through the transistor Q1 as the collector current when a voltage is applied to the base terminal of the transistor Q1.

The voltage input to the base terminal of the transistor Q1 to control the collector current is the output voltage of an operational amplifier IC1. The PWM signal output from the controller 100 is smoothened by a resistor R7 and a capacitor C1. A smoothened control voltage V− is input to the inversion input terminal (− terminal) of the operational amplifier IC1. A voltage output from the operational amplifier IC1 is divided by resistors R9 and R10 and input to the base terminal of the transistor Q1. As described above, the current generated by the secondary transfer voltage Vt2 flows through the transistor Q1 as the collector current when the voltage is applied to the base terminal of the transistor Q1, whereby a voltage is generated between the collector and the emitter of the transistor Q1 and used as the primary transfer voltage Vt1. The generated primary transfer voltage Vt1 is divided by resistors R5 and R6, and a resulting voltage is input to the input terminal (+ terminal) of the operational amplifier IC1 as a monitor voltage V+. Accordingly, the size of the primary transfer voltage Vt1 is determined according to the size of the control voltage V− by the virtual short (V+=V−) of the operational amplifier IC1. The control voltage V− is controlled by the on-duty of the PWM signal. That is, when the on-duty of the PWM signal increases, both the control voltage V− and the primary transfer voltage Vt1 becomes large. Conversely, when the on-duty of the PWM signal reduces, both the control voltage V− and the primary transfer voltage Vt1 becomes small.

As described above, the embodiment employs the configuration in which the voltage of the transistor Q1 is controlled by the PWM signal from the controller 100 to determine the primary transfer voltage. Note that a resistor R8 and a capacitor C2 in FIG. 3 are provided as elements to determine the response of the transistor Q1. The PWM signal from the controller 100 is used to control the control voltage V− in the embodiment, but the voltage adjustment portion may have other configurations. For example, the same effect is obtained even with a configuration using the D/A port of the controller 100.

Figure 4:
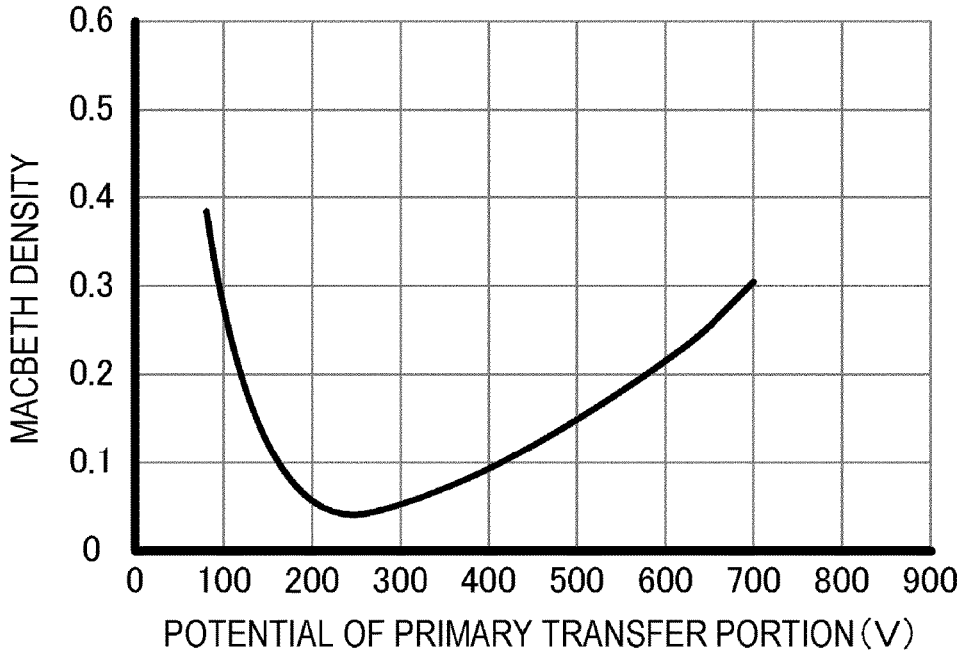
FIG. 4 is a diagram showing a relationship between a potential of an intermediate transfer belt and transfer efficiency in the first embodiment.

FIG. 4 shows the measurement results of transfer efficiency in the primary transfer portion having the configuration of the embodiment. The value of the transfer efficiency in a vertical axis shows results obtained by measuring primary transfer residual density with a Macbeth densitometer (manufacturer: Gretag Macbeth Ltd). Since the primary transfer residual density becomes larger in proportion to the value, the transfer efficiency deteriorates. As the measurement conditions in FIG. 4, the photosensitive drum and the intermediate transfer belt 10 are new and the measurement is conducted at a temperature of 23° C. and a relative humidity of 50%, i.e., a so-called N/N environment (normal temperature and normal humidity environment). Under the above conditions, optimum primary transferability was obtained at a primary transfer potential of 250 V.

Figure 5A:
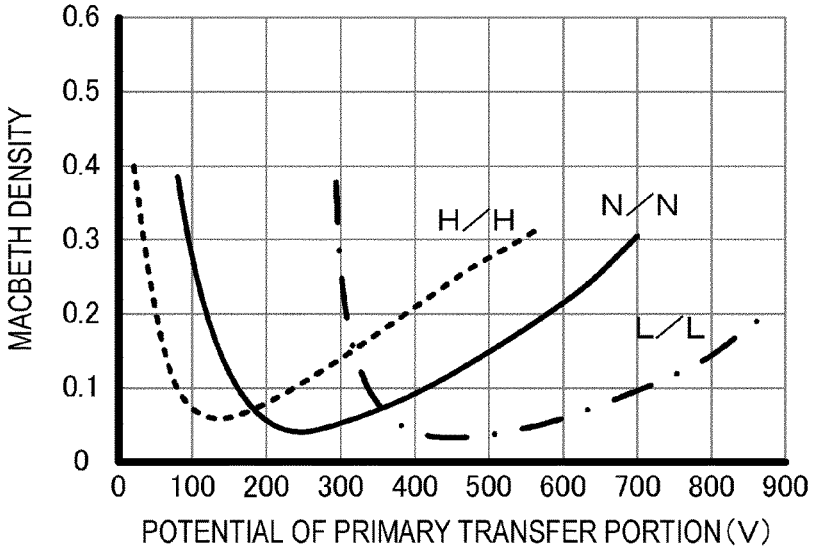
FIGS. 5A and 5B are diagrams showing fluctuations of transfer efficiency in the first embodiment.
Figure 5B:
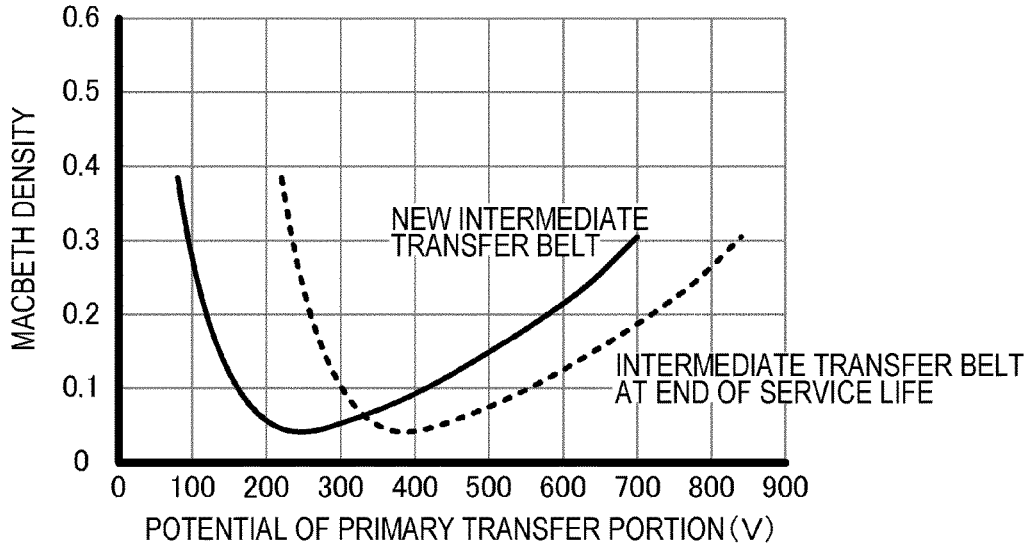

As shown in FIGS. 5A and 5B, the transfer efficiency changes with the environmental fluctuations or the endurance fluctuations of the resistance value of the intermediate transfer belt 10 in the configuration of the embodiment.

FIG. 5A is a diagram showing the transfer efficiency affected by the environmental fluctuations of the resistance value of the intermediate transfer belt 10. Optimum transfer efficiency is obtained at a low voltage under a high temperature and high humidity environment (H/H: at a temperature of 30° C. and a relative humidity of 80%) and obtained at a high voltage under a low temperature and low humidity environment (L/L: at a temperature of 15° C. and a relative humidity of 10%).

FIG. 5B is a diagram showing the transfer efficiency affected by the endurance fluctuations of the resistance value of the intermediate transfer belt 10. It appears that as the number of printed sheets increases, i.e., as the number of the times of image forming operations increases, a voltage to obtain optimum transfer efficiency increases due to an increase in resistance in the intermediate transfer belt 10 of the embodiment.

In view of the above circumstances, the present inventors have determined an optimum voltage for the primary transfer in the following way. First, in order to deal with the above fluctuations of the transfer efficiency, the transistor Q1 variable in the range of 0 V to 600 V was used as the voltage adjustment member. The resistance value fluctuations of the intermediate transfer belt 10 according to a surrounding environment are predicted and a bias setting table corresponding to the output value of the environmental sensor 106 is generated in advance to determine an optimum primary transfer voltage. In the configuration of the present invention, the primary transfer voltage is determined with reference to the bias setting table of the following table 1.

TABLE 1

[Absolute water amount and primary transfer bias (bias setting table)]

| | Absolute water amount ($g/m^3$) | | | | | |
|---|---|---|---|---|---|---|
| | ~1.5 | ~5.0 | ~10.0 | ~15.0 | ~18.0 | 18.0~ |
| Primary transfer voltage | 450 V | 350 V | 250 V | 210 V | 170 V | 150 V |

Figure 6:
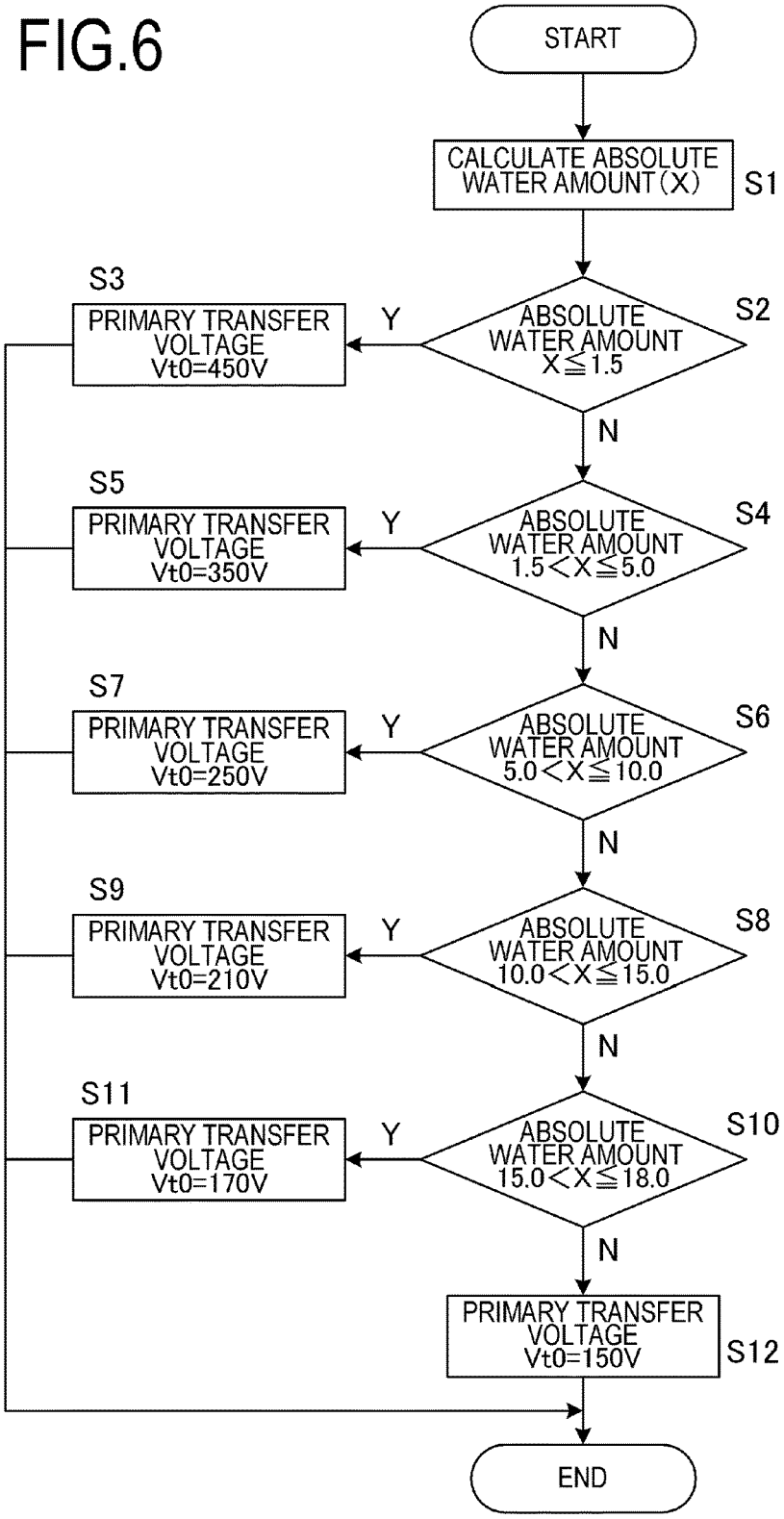
FIG. 6 is a flowchart for describing control in the first embodiment.

A description will be given, with reference to FIG. 6, of a control flow in the embodiment. After receiving an image forming instruction, the controller 100 collects information on the environmental sensor 106 to calculate an absolute water amount (X) (S1). Then, a primary transfer voltage corresponding to the value of the absolute water amount (X) is selected from the bias setting table (table 1) (S2 to S12). In order to obtain the value selected here, the primary transfer control portion 104 controls the voltage adjustment circuit 15 to set the primary transfer voltage. For example, when the absolute water amount is 10.64 $g/m^3$, 210 V is set as the primary transfer voltage at a temperature of 23° C. and a relative humidity of 50%, i.e., under a so-called N/N environment. It appears from the graph of FIG. 4 that the optimum voltage is set as primary transferability, and thus an excellent image is obtained.

As described above, the resistance fluctuations of the intermediate transfer belt 10 according to a surrounding environment are predicted with the use of the transistor Q1 as the voltage adjustment unit for the primary transfer in the embodiment, whereby an appropriate primary transfer voltage may be determined and excellent primary transferability may be ensured.

In the embodiment, the resistance fluctuations of the intermediate transfer belt 10 according to a surrounding environment were predicted to determine the primary transfer voltage. However, as shown in FIG. 5B, it appears that the resistance value of the intermediate transfer belt 10 fluctuates with an increase in the number of the times of image forming operations. Therefore, correction is performed according to the use situation of the intermediate transfer belt 10 shown in table 2, whereby it becomes possible to further stably ensure the primary transferability.

TABLE 2

[Corrected value of primary transfer correction voltage in use situation of intermediate transfer belt (correction table)]

| Service life of intermediate transfer belt | 100%~ | 95%~ | 90%~ | 80%~ | 60%~ |
|---|---|---|---|---|---|
| Primary transfer correction voltage | 0 V | 40 V | 75 V | 100 V | 150 V |

Figure 7:
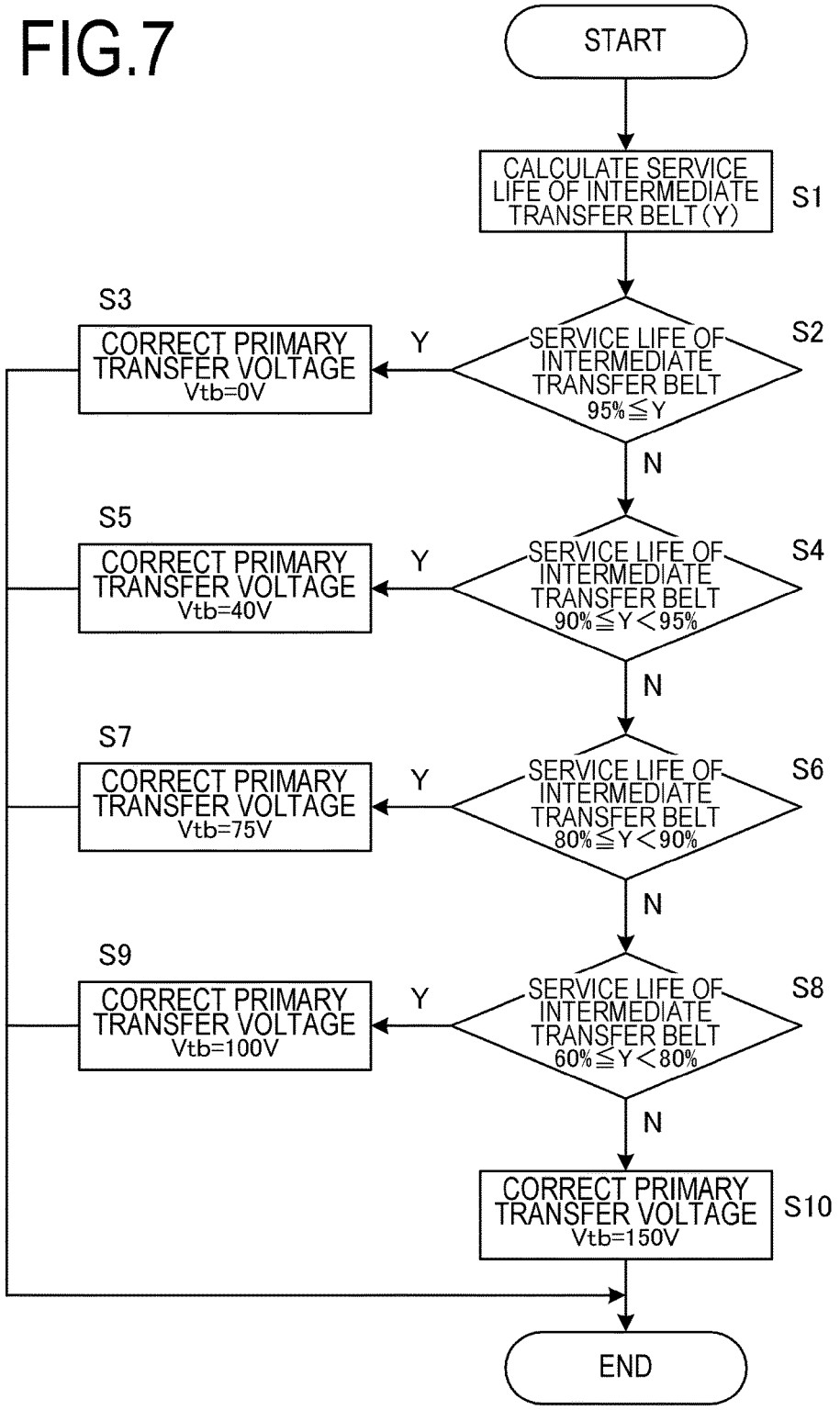
FIG. 7 is a flowchart for describing control in the first embodiment.

FIG. 7 shows a control flow using information on the service life of the intermediate transfer belt 10. That is, as shown in the control flow of FIG. 7, information on the service life (Y) of the intermediate transfer belt 10 is first acquired with respect to the primary transfer voltage set in the control flow of FIG. 6. (S1). Then, based on the acquired information, a primary transfer correction voltage corresponding to the service life (Y) of the intermediate transfer belt 10 is determined from the correction table (table 2) (S2 to S10). Here, the determined primary transfer correction voltage is added to the above primary transfer voltage to determine a final primary transfer potential. Specifically, when the primary transfer voltage obtained from the bias setting table is expressed as Vt0 and the correction voltage obtained from the correction table is expressed as Vtb, the finally determined primary transfer voltage Vt1 is calculated as follows.

$$Vt1=Vt0+Vtb$$

That is, the controller 100 changes the size of the control signal output to the voltage adjustment circuit 15 to change the amount of the current supplied to the intermediate transfer belt 10 such that the size of the primary transfer potential becomes larger as the remaining service life of the intermediate transfer belt 10 becomes shorter. Note that in the embodiment, the above use situation of the intermediate transfer belt 10 is determined in such a way that the CPU circuit portion 150 serving not only as the control portion but also as acquisition unit collects information on the number of printed sheets accumulated in the RAM 152 of the image forming apparatus. However, other information may be acquired as the information on the service life. For example, the same effect is obtained even with image information such as the number of the total pixels of an image obtained by an image forming operation, the time of the rotation of the intermediate transfer belt 10, and the number of the rotation times of the intermediate transfer belt 10.

As described above, in the embodiment, although a primary transfer voltage is generated from a secondary transfer voltage after a current necessary for secondary transfer is ensured from a secondary transfer power supply 21, it is possible to separately set the primary transfer voltage with the use of a transistor as the voltage adjustment unit for primary transfer. Further, regardless of a surrounding environment and the use situation of an intermediate transfer belt 10, an appropriate primary transfer voltage may be determined and excellent primary transferability may be ensured. In addition, it is possible to select optimum settings as secondary transfer voltage settings.

In the embodiment, a transistor is used as the voltage adjustment member to adjust the voltage of the primary transfer portion. However, an element such as a digital volume (digital variable resistor) may be used so long as the same effect is obtained by the element. That is, it may be possible to use an element capable of changing the size of a current supplied from the secondary transfer roller 20 to the intermediate transfer belt 10 according to the size of a control signal such as a PWM signal variable in size.

Figure 8:
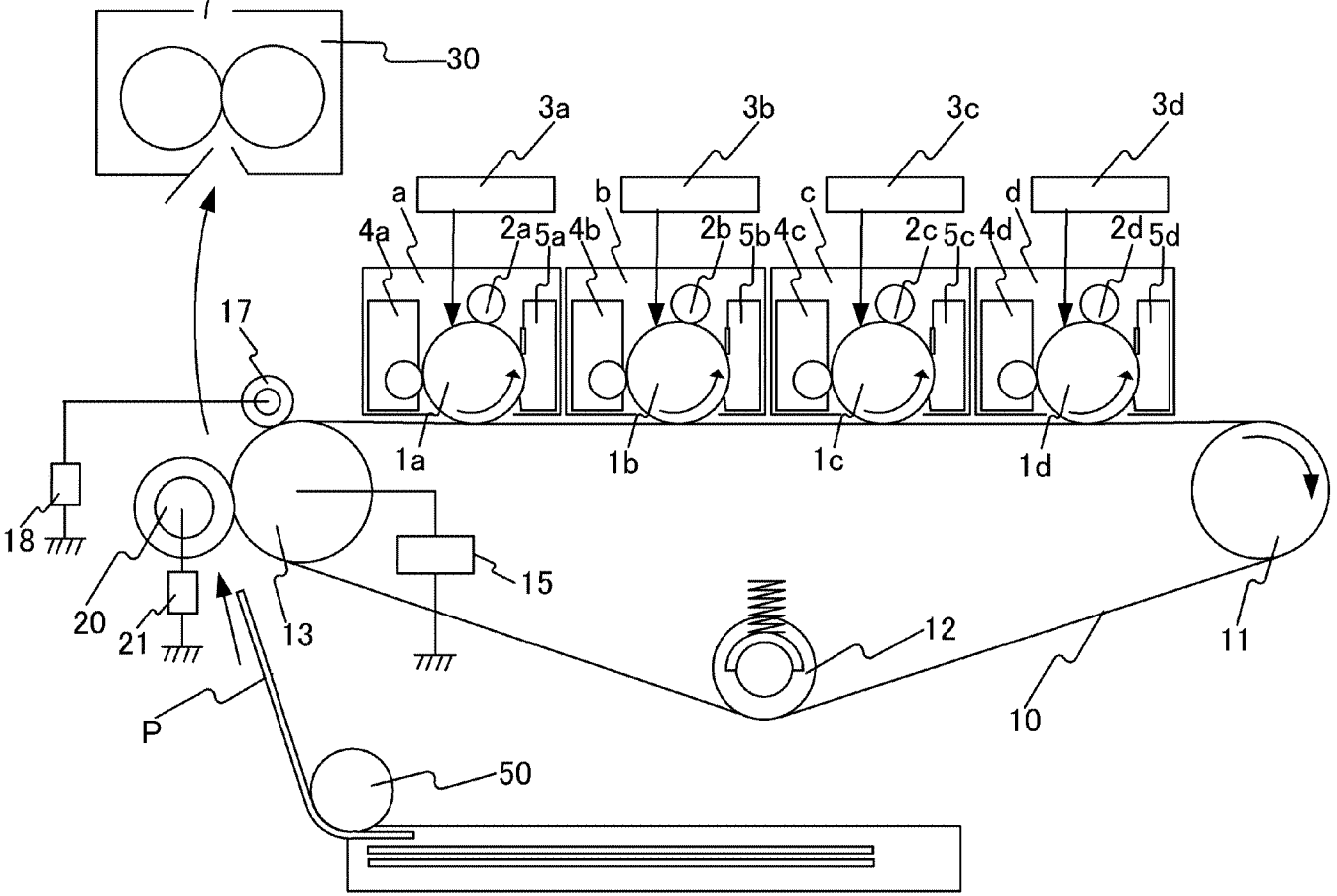
FIG. 8 is a diagram for describing another configuration example in the first embodiment.

FIG. 8 is a schematic cross-sectional diagram showing the schematic configuration of the image forming apparatus according to a modified example of the embodiment. The embodiment is based on the voltage applied to the secondary transfer roller 20 serving as a current supply member. However, the configuration is not limited to this. As shown in the modified example of FIG. 8, a current based on the application of a voltage to a cleaning roller 17 that charges toner on the intermediate transfer belt 10 may be used. In addition, the same effect is obtained even with the use of the overlapped currents of both the above secondary transfer roller 20 serving as a first current supply member and the cleaning roller 17 serving as a second current supply member.

Second Embodiment

Figure 9:
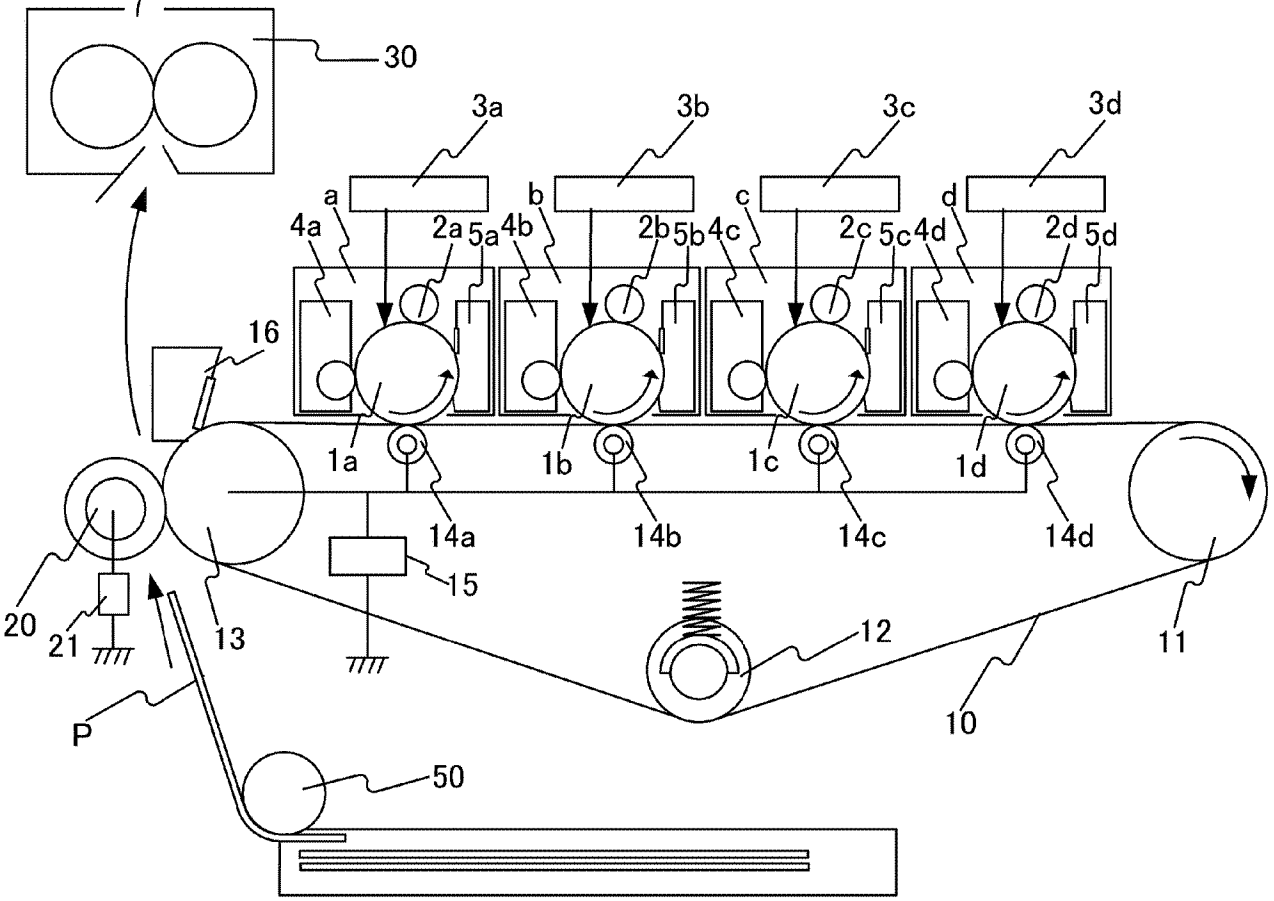
FIG. 9 is a diagram for describing an image forming apparatus according to a second embodiment.
Figure 10:
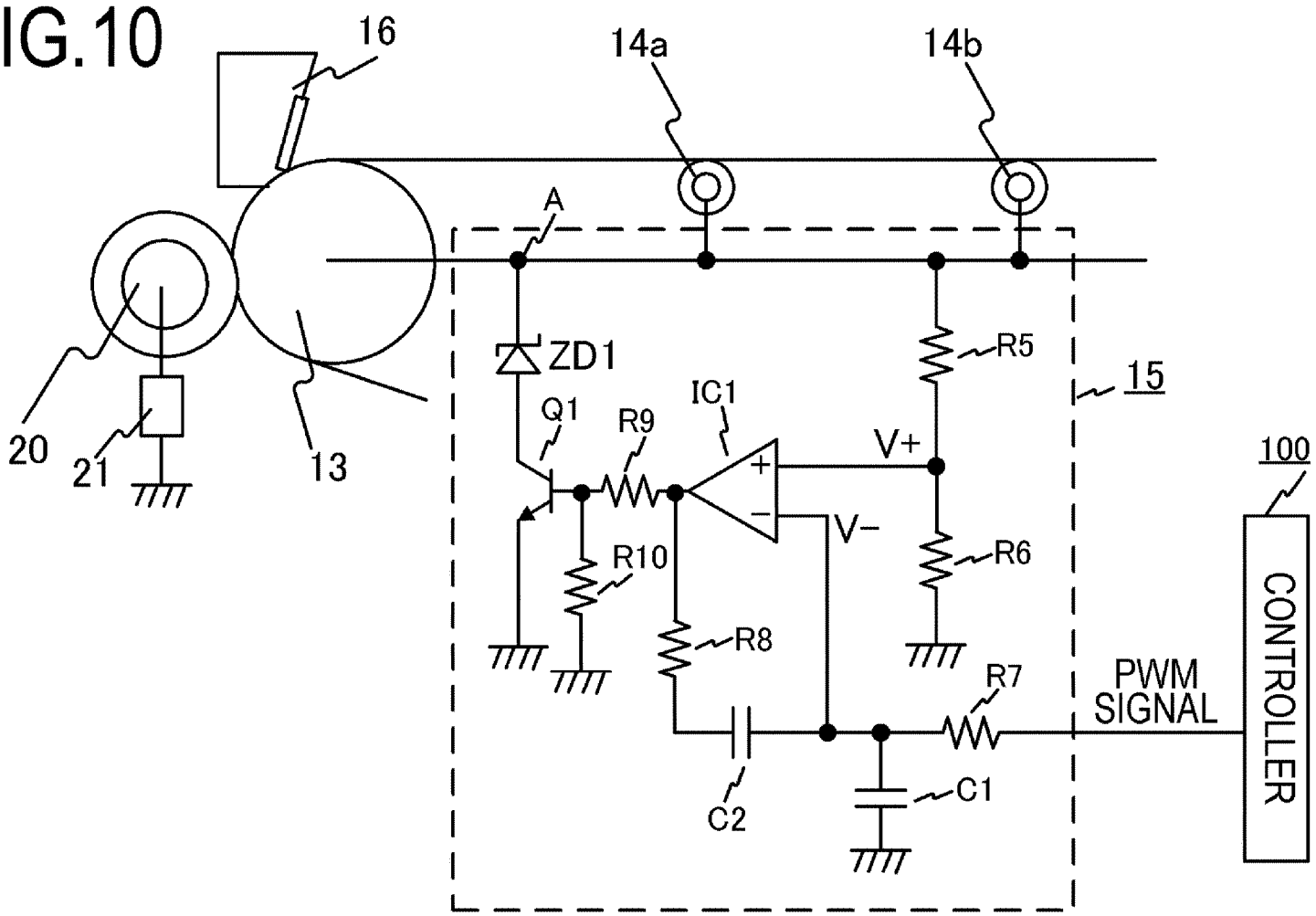
FIG. 10 is a diagram for describing a circuit of a primary transfer portion in the second embodiment.

A description will be given, with reference to FIGS. 9 and 10, of an image forming apparatus according to a second embodiment of the present invention. In the image forming apparatus according to the second embodiment, the same configurations as those of the first embodiment will be denoted by the same symbols, and their descriptions will be omitted. FIG. 9 is a schematic diagram of the image forming apparatus according to the second embodiment of the present invention, and FIG. 10 is a diagram for describing the circuit configuration of a primary transfer portion in the second embodiment of the present invention.

As shown in FIG. 9, primary transfer rollers 14*a*, 14*b*, 14*c*, and 14*d* serving not only as primary transfer members but also as contact members are arranged at positions opposing photosensitive drums 1*a*, 1*b*, 1*c*, and 1*d*, respectively, via an intermediate transfer belt 10 in the configuration of the embodiment. Further, a secondary transfer opposing roller 13, by which the intermediate transfer belt 10 is extended, and the primary transfer rollers 14*a* to 14*d* are grounded via a Zener diode serving as a voltage stabilizing element (voltage maintaining element) connected in series to a transistor serving as a voltage adjustment member.

The primary transfer rollers 14*a* to 14*d* contact the photosensitive drums 1*a* to 1*d*, respectively, with a prescribed pressing force in a state of sandwiching the intermediate transfer belt 10 and rotate following the intermediate transfer belt 10. In the embodiment, the arrangement of the primary transfer rollers 14*a* to 14*d* results in an increase in the number of components but allows a high degree of flexibility in selecting the intermediate transfer belt 10.

A yellow toner image formed on the photosensitive drum 1*a* is transferred onto the intermediate transfer belt 10 (primary transfer) when passing through the primary transfer nip between the photosensitive drum 1*a* and the intermediate transfer belt 10. A primary transfer roller serving as a primary transfer member has an outer diameter of 12 mm in which a nickel-plated steel rod having an outer diameter of 6 mm is covered with a blowing sponge body mainly composed of NBR adjusted to have a volume resistance of $10^7$ Ω·cm and a thickness of 3 mm and epichlorohydrin rubber. In addition, the primary transfer roller 14*a* contacts the photosensitive drum 1*a* with an applied pressure of 10 N and forms the primary transfer nip.

A description will be given, with reference to FIG. 10, of voltage adjustment unit in the embodiment. In the embodiment, the primary transfer rollers 14*a* to 14*d* are arranged as the primary transfer members, and a voltage necessary for the primary transfer becomes higher by an amount corresponding to the resistance of the primary transfer members compared with the first embodiment. Therefore, as shown in FIG. 10, a Zener diode ZD1 serving as voltage maintaining unit is connected in series to a transistor Q1 serving as a voltage adjustment member. When a secondary transfer voltage Vt2 (here 2100 V) is output from a secondary transfer power supply 21, a current flows through the Zener diode ZD1 via a secondary transfer roller 20, the intermediate transfer belt 10, and a secondary transfer opposing roller 13. At this time, the current sufficiently flows to generate the yield voltage of the Zener diode ZD1 to maintain a yield state, and the Zener diode ZD1 maintains the yield voltage as a prescribed potential. A final primary transfer voltage is a value obtained by adding together a variably adjusted voltage output from the transistor Q1 and the yield voltage maintained at a prescribed size by the Zener diode ZD1. Thus, the selection of a further higher primary transfer voltage is allowed. The specific operation of the circuit is the same as that of the first embodiment.

In the embodiment, the Zener diode ZD1 serving as the voltage maintaining unit for maintaining a potential of 500 V was used, and the transistor Q1 serving as the voltage adjustment unit variable in the range of 0 V to 600 V like the first embodiment was used. Therefore, in the configuration of the embodiment, it becomes possible to control the potential of the primary transfer portion in the range of 500 V to 1100 V. In the configuration of the embodiment, optimum primary transferability may be ensured using a reference voltage shown in the following table 3.

TABLE 3

[Absolute water amount and primary transfer voltage (reference table)]

| | Absolute water amount (g/m$^3$) | | | | | |
|---|---|---|---|---|---|---|
| | ~1.5 | ~5.0 | ~10.0 | ~15.0 | ~18.0 | 18.0~ |
| Primary transfer voltage | 1050 V | 850 V | 750 V | 650 V | 570 V | 550 V |

The control flow of the embodiment is the same as that of the first embodiment.

As described above, the embodiment is so configured that a transistor is used as voltage adjustment unit for primary transfer and a Zener diode is used as voltage maintaining unit, the transistor and the Zener diode being connected in series to each other. Thus, even with a primary transfer member having high resistance, an appropriate primary transfer voltage may be determined and excellent primary transferability may be ensured.

Note that in the embodiment as well, primary transferability may be further improved as a matter of course in such a way as to perform correction according to the use situation (the remaining service life) of the intermediate transfer belt 10 described in the first embodiment. In addition, the Zener diode is used as the voltage maintaining unit in the embodiment. However, the voltage maintaining unit is not limited to such an element, and an element such as a varistor may be used so long as the same effect is obtained by the element. In addition, the roller members are used as the primary transfer members in the embodiment. However, the same effect is obtained even with, for example, conductive brushes or conductive sheet members.

Third Embodiment

Figure 11:
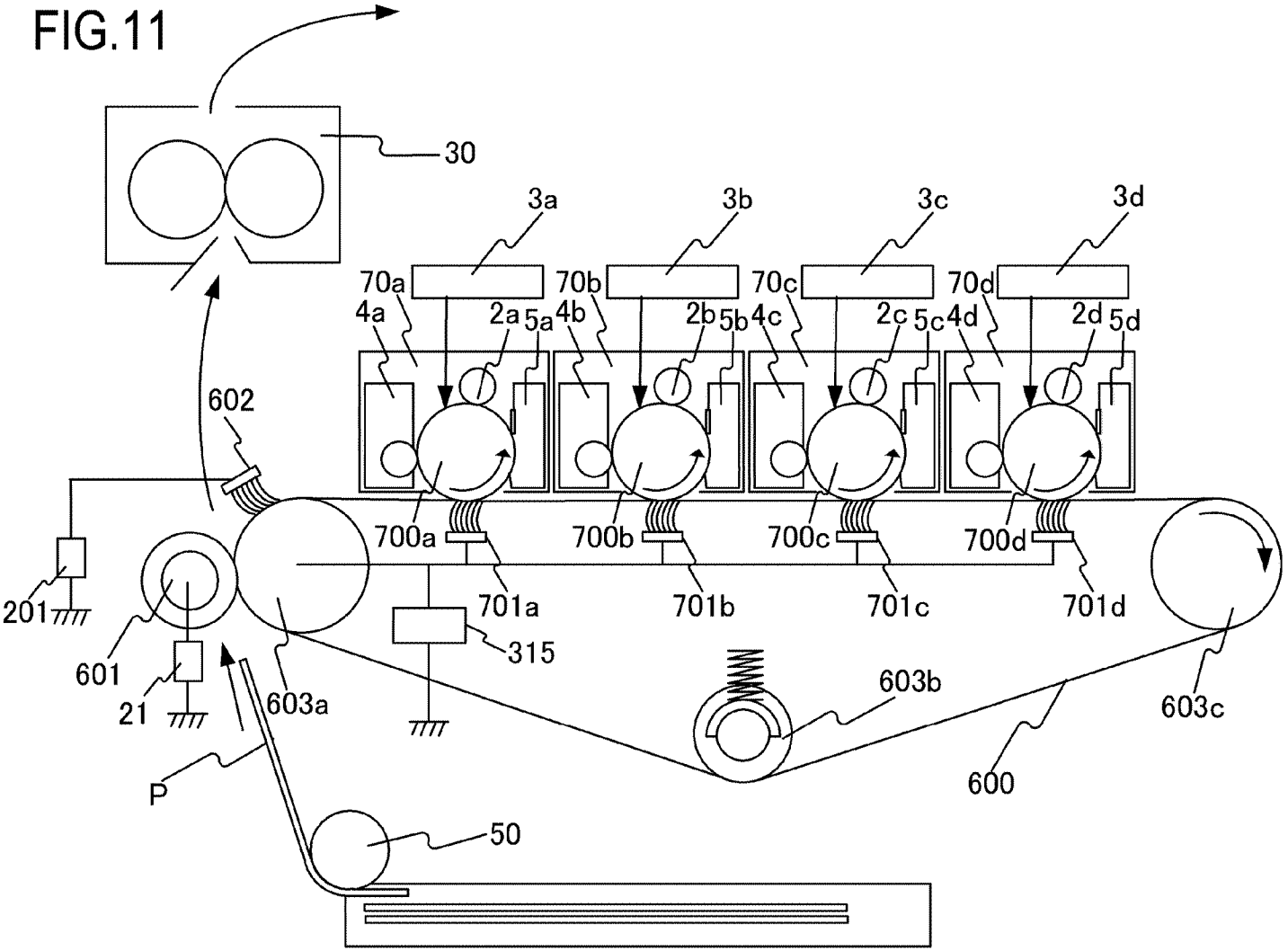
FIG. 11 is a diagram for describing an image forming apparatus according to a third embodiment.

FIG. 11 is a schematic diagram of an image forming apparatus according to a third embodiment of the present invention. In the description of the embodiment, first to fourth image forming stations will be denoted by symbols 70*a* to 70*d*, photosensitive drums will be denoted by symbols 700*a* to 700*d*, an intermediate transfer belt will be denoted by symbol 600, a driving roller will be denoted by symbol 603*c*, a tension roller will be denoted by symbol 603*b*, a secondary transfer opposing roller will be denoted by symbol 603*a*, and a secondary transfer roller will be denoted by symbol 601. Other than these components, the same configurations as those of the first and second embodiments will be denoted by the same symbols, and their descriptions will be omitted in the image forming apparatus according to the third embodiment. In the third embodiment, matters that will not be particularly described are the same as those of the first and second embodiments. Note that the image forming apparatus according to the embodiment is so configured that, for instance, toner (residual toner) on the intermediate transfer belt 600 after secondary transfer is charged by a cleaning brush 602 and then reversely transferred onto the photosensitive drums 700*a* to 700*d* to be cleaned and removed. The configuration of a controller 100 that controls the body of the image forming apparatus of the third embodiment is the same as those of the first and second (FIG. 2) embodiments.

Comparative Example

Figure 17:
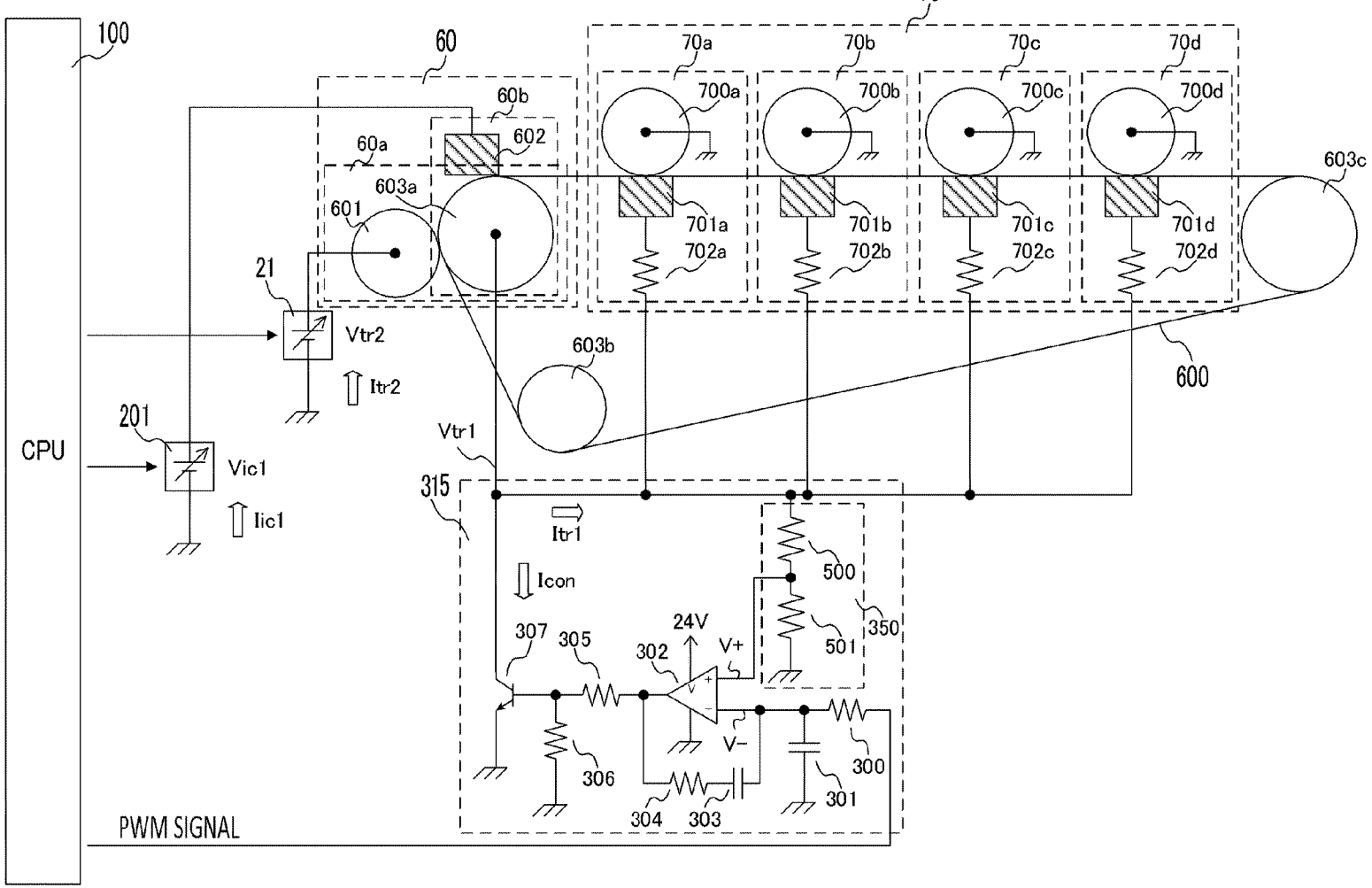
FIG. 17 is a configuration diagram of a transfer portion of an image forming apparatus according to a comparative example.

A description will be given, with reference to FIG. 17, of a comparative example of the third embodiment. FIG. 17 schematically shows the transfer portion of the image forming apparatus configured to generate a primary transfer current Itr1 with the supply of a current from the opposing member of the secondary transfer opposing roller 603*a*. The primary transfer current Itr1 is supplied from the secondary transfer roller 601 and the cleaning brush 602. In addition, a primary transfer voltage Vtr1 is generated based on a secondary transfer voltage source 21 and a cleaning voltage source 201 and configured to allow constant voltage control in a certain voltage range. The generated primary transfer voltage Vtr1 forms the surface potential of the intermediate transfer belt 600. Further, based on the potential differences (transfer contrast) between the surface potential of the intermediate transfer belt 600 and the potentials of the photosensitive drums 700*a* to 700*d*, toner on the photosensitive drums 700*a* to 700*d* moves onto the intermediate transfer belt 600 to perform primary transfer.

A CPU 100 serving as a control portion outputs a voltage generation signal to the secondary transfer voltage source 21 and the cleaning voltage source 201. Based on the signal, the secondary transfer voltage source 21 applies a direct current having a positive polarity to the secondary transfer roller 601, and the cleaning voltage source 201 applies a direct voltage having a positive polarity to the cleaning brush 602. A secondary transfer current Itr2 flowing through the secondary transfer roller 601 and a cleaning current Iic1 flowing through the cleaning brush 602 merge with each other via the intermediate transfer belt 600 and the secondary transfer opposing roller 603*a*. Then, the current diverges into the primary transfer current Itr1 necessary for the primary transfer and a control current Icon flowing through a current control circuit 315. The primary transfer current Itr1 flows into the ground via resistors 702*a*, 702*b*, 702*c*, and 702*d*, primary transfer brushes 701*a*, 701*b*, 701*c*, and 701*d*, the intermediate transfer belt 600, and the photosensitive drums 700*a*, 700*b*, 700*c*, and 700*d*.

The image forming apparatus of FIG. 17 is a so-called tandem type image forming apparatus in which the four image forming stations 70*a*, 70*b*, 70*c*, and 70*d* are provided. The first image forming station 70*a* forms an image of yellow (Y), the second image forming station 70*b* forms an image of magenta (M), the third image forming station 70*c* forms an image of cyan (C), and the fourth image forming station 70*d* forms an image of black (Bk). The resistors 702*a*, 702*b*, 702*c*, and 702*d* are arranged to reduce the fluctuations of the primary transfer current between the image forming stations 70*a* to 70*d*. On the other hand, the control current Icon flowing through the current control circuit 315 flows into the ground via a transistor 307. Note that currents flowing into the ground via resistors 500 and 501 are not taken into consideration since they are minute. The control of the primary transfer voltage Vtr1 is performed by the control of the collector current of the transistor 307 such that a control voltage V− input to the inversion input terminal of an operational amplifier 302 and a monitor voltage V+ input to the non-inversion input terminal of the operational amplifier 302 are the same. The relationship between the primary transfer voltage Vtr1 and the control voltage V− is expressed by the following formula (1).

$$Vtr1=(V-)=((R500+R501)/R501) \quad (1)$$

Note that R500 and R501 are the resistance values of the resistors 500 and 501, respectively, and a current flowing through the input terminal of the operational amplifier 302 is not taken into consideration since it is minute. The monitor voltage V+ is a direct current obtained by dividing the primary transfer voltage Vtr1 by the resistors 500 and 501. On the other hand, the control voltage V− is a direct current obtained by smoothening a PWM signal serving as a current adjustment signal (control signal variable in size) output from the CPU 100 by a resistor 300 and a capacitor 301. The control voltage V− changes with the on-duty (on-duty ratio) of the PWM signal. The control voltage V− becomes larger as the on-duty increases, and the primary transfer voltage Vtr1 becomes larger according to the above formula (1). A resistor 304 and a capacitor 303 are connected as elements to determine the response of the operational amplifier 302. The output voltage of the operational amplifier 302 is divided by resistors 305 and 306 and input to the base terminal of the transistor 307. Thus, the collector current of the transistor 307 is controlled. The primary transfer voltage Vtr1 is generated as the collector-emitter voltage of the transistor 307.

In the configuration, an endless polyethylene terephthalate (PET) resin obtained by mixing an ion conducting agent as a conducting agent or the like is used as the intermediate transfer belt. As electrical characteristics, a resistance value fluctuates with respect to temperature and humidity in an atmosphere since the intermediate transfer belt exhibits ion conducting characteristics and electrical conductivity is obtained when ions are transmitted between high polymer chains. In addition, the resistance value of the primary transfer brush used in the configuration increases with energization deterioration due to the endurance of the image forming apparatus. In order to ensure the primary transfer current necessary to deal with the fluctuations of the resistance value of a primary transfer load like this, it is necessary to change the primary transfer voltage.

When the resistance value of a primary transfer load is predicted from a surrounding environment and an endurance sheet number and a primary transfer voltage is determined according to the resistance value of the predicted primary transfer load in the configuration of the above comparative example, there is a case that the determined applied voltage does not become optimum depending on the fluctuations of a load resistance value.

Figure 12:
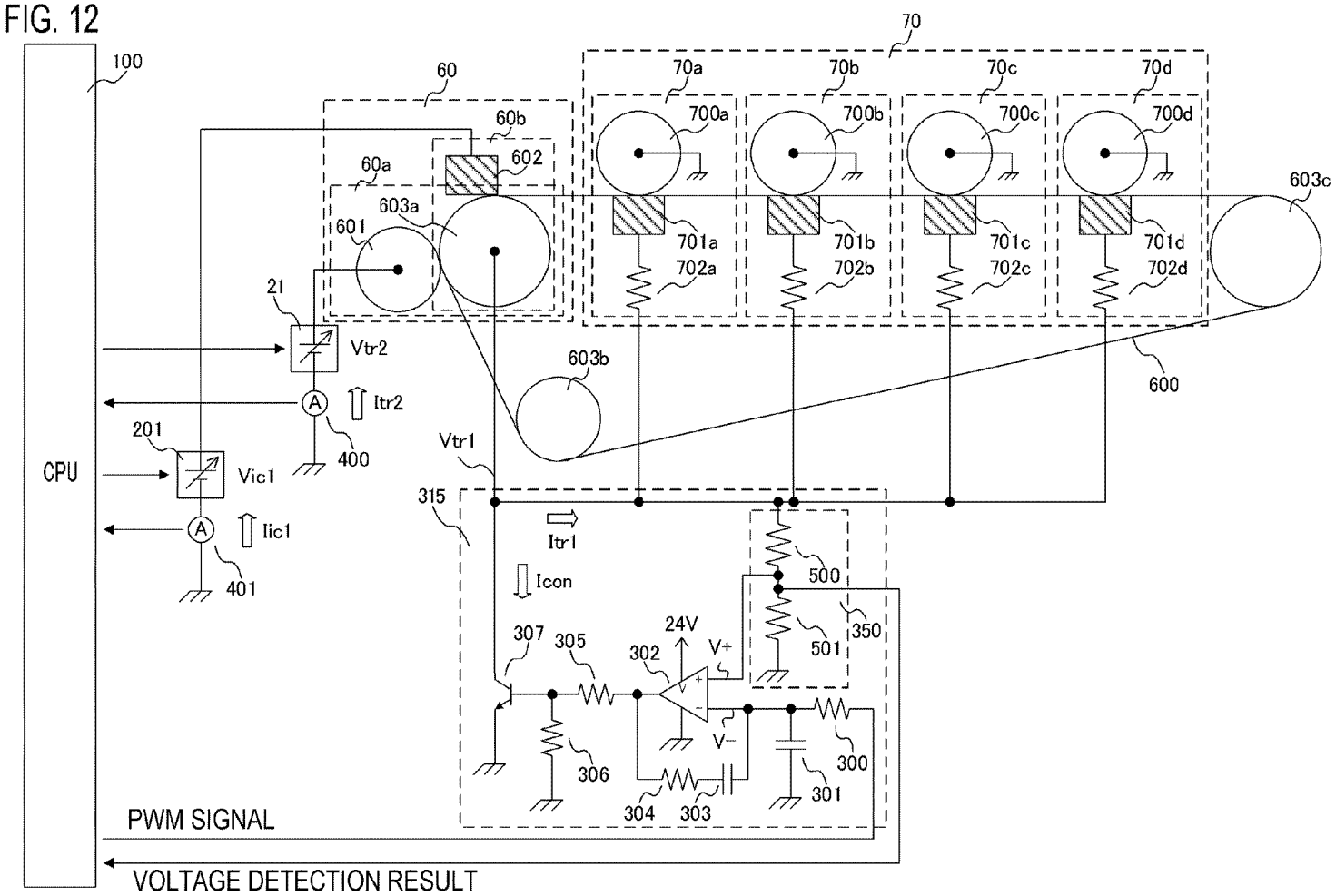
FIG. 12 is a configuration diagram of a transfer portion of the image forming apparatus according to the third embodiment.

FIG. 12 is a diagram for describing the transfer portion of the image forming apparatus according to the third embodiment of the present invention. The descriptions of the same functions as those of the above comparative example will be omitted, and the same components as those of the comparative example are denoted by the same symbols. The embodiment is mainly different from the comparative example in that the resistance value of a primary transfer load is calculated and acquired from a current detection result obtained by detecting the amount of a current flowing through an upstream electric load or upstream current consumer and a voltage detection result obtained by detecting the value (first voltage value) of a voltage applied to a downstream electric load or downstream current consumer.

The upstream electric load of the embodiment includes a resistance component from the secondary transfer roller 601 to the secondary transfer opposing roller 603*a* via the intermediate transfer belt 600 (that is, an upstream electric load 60*a*) and a resistance component from the cleaning brush 602 to the secondary transfer opposing roller 603*a* via the intermediate transfer belt 600 (that is, an upstream electric load 60*b*). In addition, the downstream electric load of the embodiment includes a resistance component from the secondary transfer opposing roller 603*a* to the ground via primary transfer brushes 701*a*, 701*b*, 701*c*, and 701*d*. In addition, like the comparative example, a current control circuit 315 is connected in parallel to a downstream electric load 70 and controls a primary transfer voltage Vtr1 by controlling a control current Icon flowing through itself.

The image forming apparatus of FIG. 12 is designed to control the primary transfer voltage Vtr1 in the range of 0 V to 600 V. The withstand voltage of the collector-emitter voltage of a transistor 307 needs to be 600 V or more. In the embodiment, the withstand voltage is 800 V. In addition, the primary transfer voltage Vtr1 is divided by resistors 500 and 501 of a primary transfer voltage detection circuit 350 serving as a voltage detection portion and input to the non-inversion input terminal of an operational amplifier 302 as a monitor voltage V+ and input to the AD port of a CPU 100. When the primary transfer voltage Vtr1 changes in the range of 0 V to 600 V, the value of a voltage divided by the resistors 500 and 501 is designed to change in the range of 0 V to 3.0 V. On the other hand, a control voltage V− input to the inversion input terminal of the operational amplifier 302 changes with the on-duty of a PWM signal serving as a current adjustment signal output from the CPU 100. The control voltage V− becomes 0 V when the on-duty of the PWM signal is set at 0% and becomes 3.3 V when the on-duty of the PWM signal is set at 100%. The control voltage V− is designed to fall within a voltage range in which all the voltage ranges of the monitor voltage V+ may be covered.

The image forming apparatus has, as current detection portions, a secondary transfer current detection circuit 400 that detects a secondary transfer current Itr2 flowing through the secondary transfer roller 601 and a cleaning current detection circuit 401 that detects a cleaning current Iic1 flowing through the cleaning brush 602. Current detection results detected by the respective current detection circuits are output to the CPU 100. In general, the secondary transfer portion and the cleaning portion of an image forming apparatus often have respective current detection circuits, and these current detection circuits are applicable to the control of the embodiment. Here, the relationship between the secondary transfer current Itr2, the cleaning current Iic1, and the primary transfer current Itr1 is expressed by the following formula (2).

$$Itr2+Iic1=Itr1+\mathrm{Icon} \tag{2}$$

Icon is a control current flowing through the current control circuit 315. In calculating the resistance value of a primary transfer load, a state in which the control current Icon flowing through the current control circuit 315 is known is created. In the embodiment, a condition for turning off the transistor 307 is set and the control current Icon is set at 0 (zero) to create the state in which the control current is known. Specifically, the on-duty of the PWM signal output from the CPU 100 is set at 100%, and the control voltage V− is set at 3.3 V. In addition, a secondary transfer voltage Vtr2 or a cleaning voltage Vic1 at which the primary transfer voltage Vtr1 does not exceed 600 V regardless of the resistance values of an upstream electric load 60 and the downstream electric load 70 is set. For example, when the secondary transfer voltage Vtr2 is set at 600 V and the cleaning voltage Vic1 is set at 0 V, the primary transfer voltage Vtr1 does not exceed 600 V. At this time, the monitor voltage V+ becomes 3.0 V or less, the control voltage V− becomes 3.3 V, the output of the operational amplifier 302 is fixed to its lower limit, and the transistor 307 is reliably turned off. However, in this case, it is necessary to design the monitor voltage and the control voltage such that the differential input voltage range of the operational amplifier 302 is satisfied. In this case, the following formula (3) is obtained from the above formula (2).

$$Itr1=Itr2+Iic1 \tag{3}$$

Since the secondary transfer current Itr2 and the cleaning current Iic1 are detected by the current detection circuits, the primary transfer current Itr1 may be calculated and acquired. In addition, since the primary transfer voltage Vtr1 is detected by a voltage detection circuit 350 at this time, a resistance value Rtr1 of the primary transfer load may be calculated and acquired by the following formula (4).

$$Rtr1=Vtr1/(Itr2+Iic1) \tag{4}$$

Figure 13:
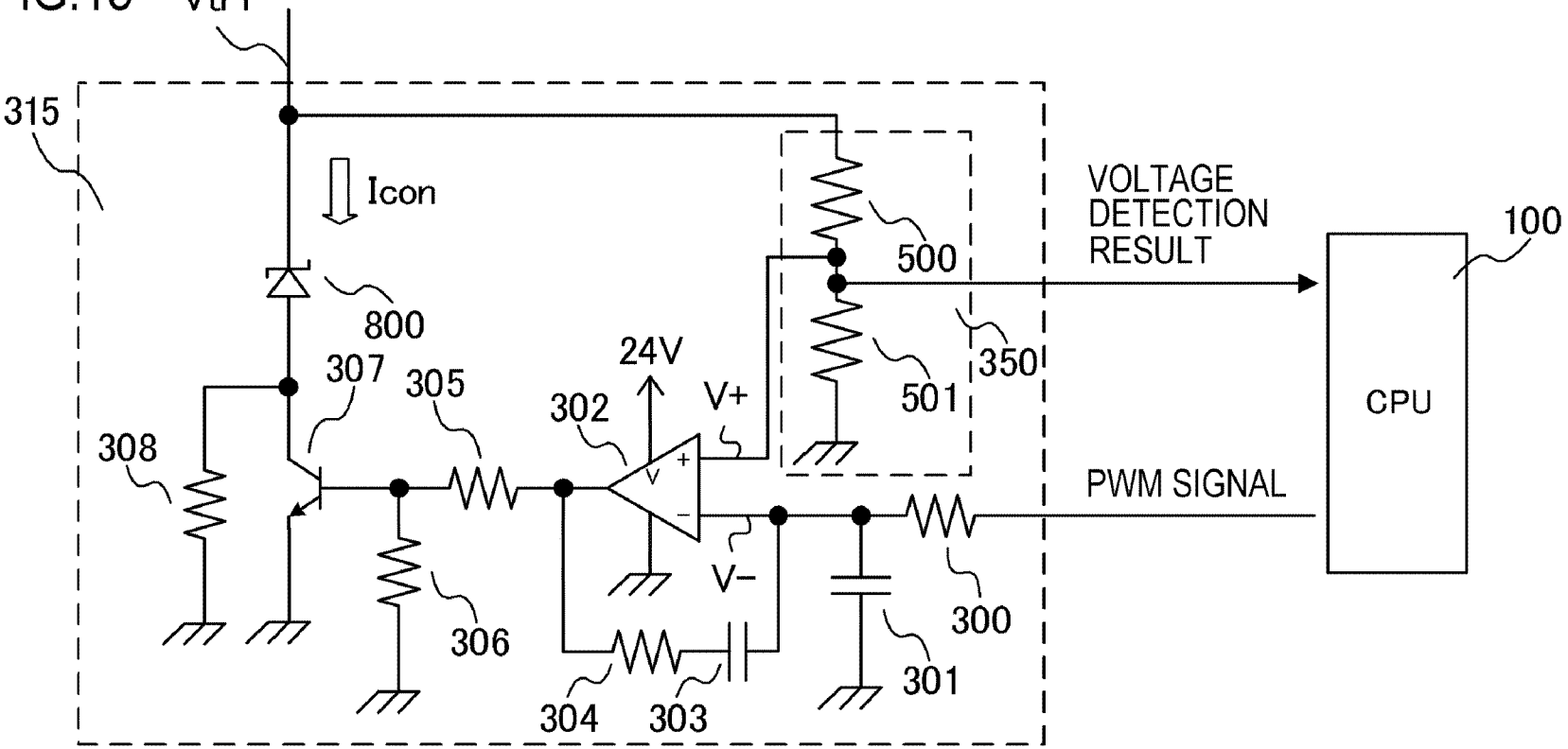
FIG. 13 is a diagram for describing a modified example of a circuit of a primary transfer portion in the third embodiment.

FIG. 13 is a schematic diagram showing a modified example of the circuit of the primary transfer portion of the embodiment. In the above embodiment, the primary transfer voltage Vtr1 is configured to be controllable in a range of 0 V to 600 V. When the primary transfer voltage Vtr1 is configured to be controllable in the range of 400 V to 1000 V using a component having the withstand voltage of the same collector-emitter voltage as that of the transistor 307 used in the embodiment, there is a case that the current control circuit is configured as shown in FIG. 13. A Zener diode 800 having a Zener voltage of 400 V is arranged as a voltage drop element (also called a voltage stabilizing element or a voltage maintaining element) between the collector terminal of the transistor 307 and the upstream electric load 60 so as to be in series with the voltage adjustment circuit 315. The primary transfer voltage Vtr1 is generated as the sum of the collector-emitter voltage of the transistor 307 and the Zener voltage of the Zener diode 800. In order to supply a sufficient Zener current to the Zener diode 800 and stably generate a Zener voltage of 400 V, a resistor 308 is arranged. When there is a need to create a state in which the control current Icon is known using the current control circuit shown in FIG. 13, it is only necessary to set a condition for turning off the transistor 307 in the same way as the above. At this time, the control current Icon may be calculated by the following formula (5) to be known.

$$\mathrm{Icon}=(Vtr1-Vzd)/R308 \tag{5}$$

Note that Vzd is the Zener voltage of the Zener diode 800, and R308 is the resistance value of the resistor 308. At this time, the primary transfer current Itr1 is calculated by the following formula (6) based on the above formula (2).

$$Itr1=Itr2+Iic1-((Vtr1-Vzd)/R308) \tag{6}$$

In addition, a resistance value Rtr1 of the primary transfer load may be calculated by the following formula (7).

$$Rtr1=Vtr1/(Itr2+Iic1-((Vtr1-Vzd)/R308)) \quad (7)$$

The CPU 100 has the table of the optimum primary transfer voltage Vtr1 corresponding to the resistance value Rtr1 of the calculated primary transfer load and performs the constant voltage control of the optimum primary transfer voltage Vtr1 corresponding to the resistance value Rtr1 of a primary transfer load calculated in an image forming operation.

Figure 14:
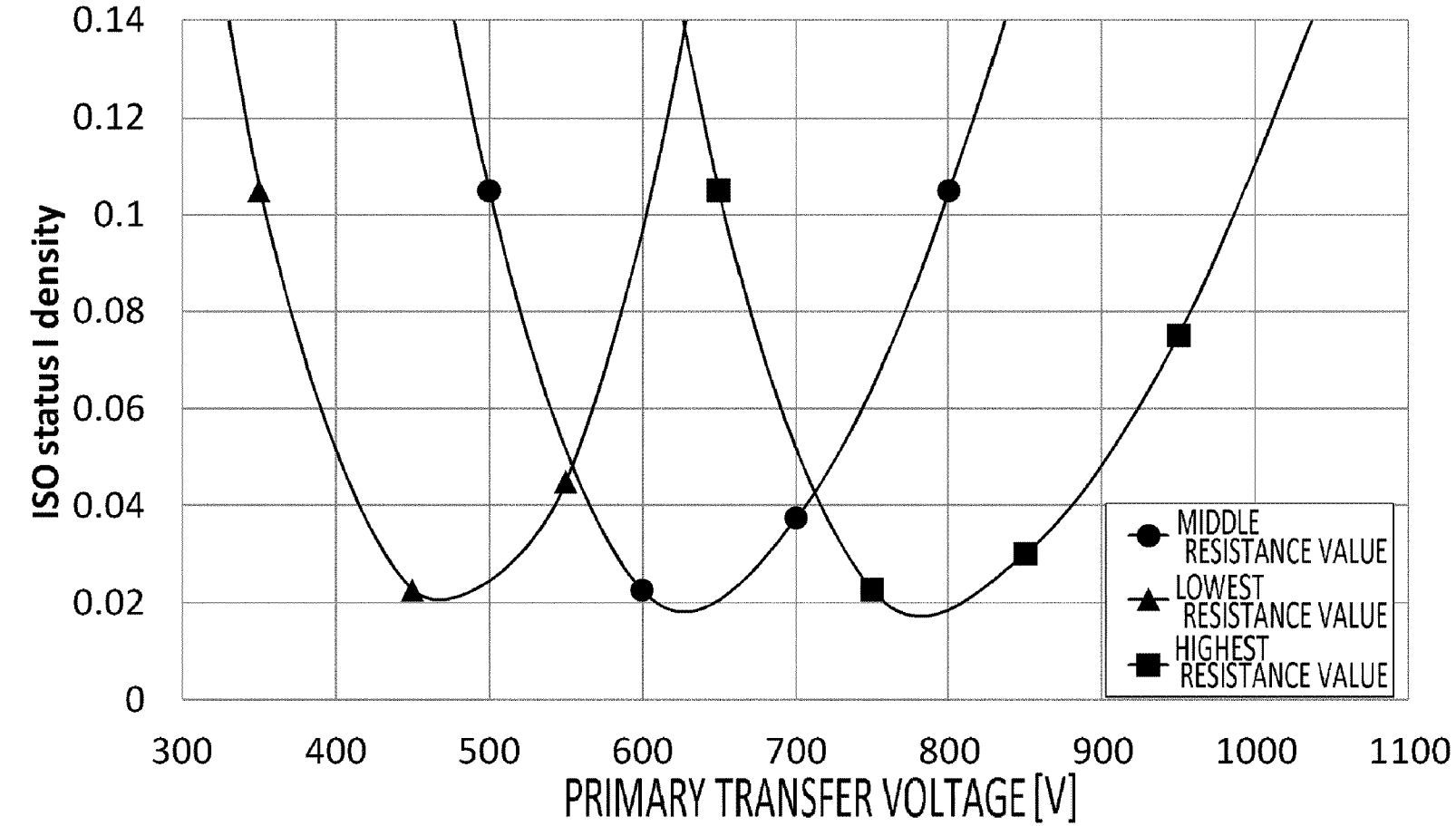
FIG. 14 is a diagram showing a transfer efficiency of the primary transfer portion in the third embodiment.

FIG. 14 shows transfer efficiency in the primary transfer portion. The value of the transfer efficiency in a vertical axis shows primary transfer residual density. Since the primary transfer residual density becomes larger in proportion to the value, the transfer efficiency deteriorates. That is, an optimum primary transfer voltage is obtained when the value of ISO status I density in the vertical axis becomes the smallest. Note that as measurement conditions shown in FIG. 14, the photosensitive drum and the intermediate transfer belt are new and the measurement is conducted at a temperature of 15° C. and a relative humidity of 10%, i.e., a so-called L/L environment.

Figure 15:
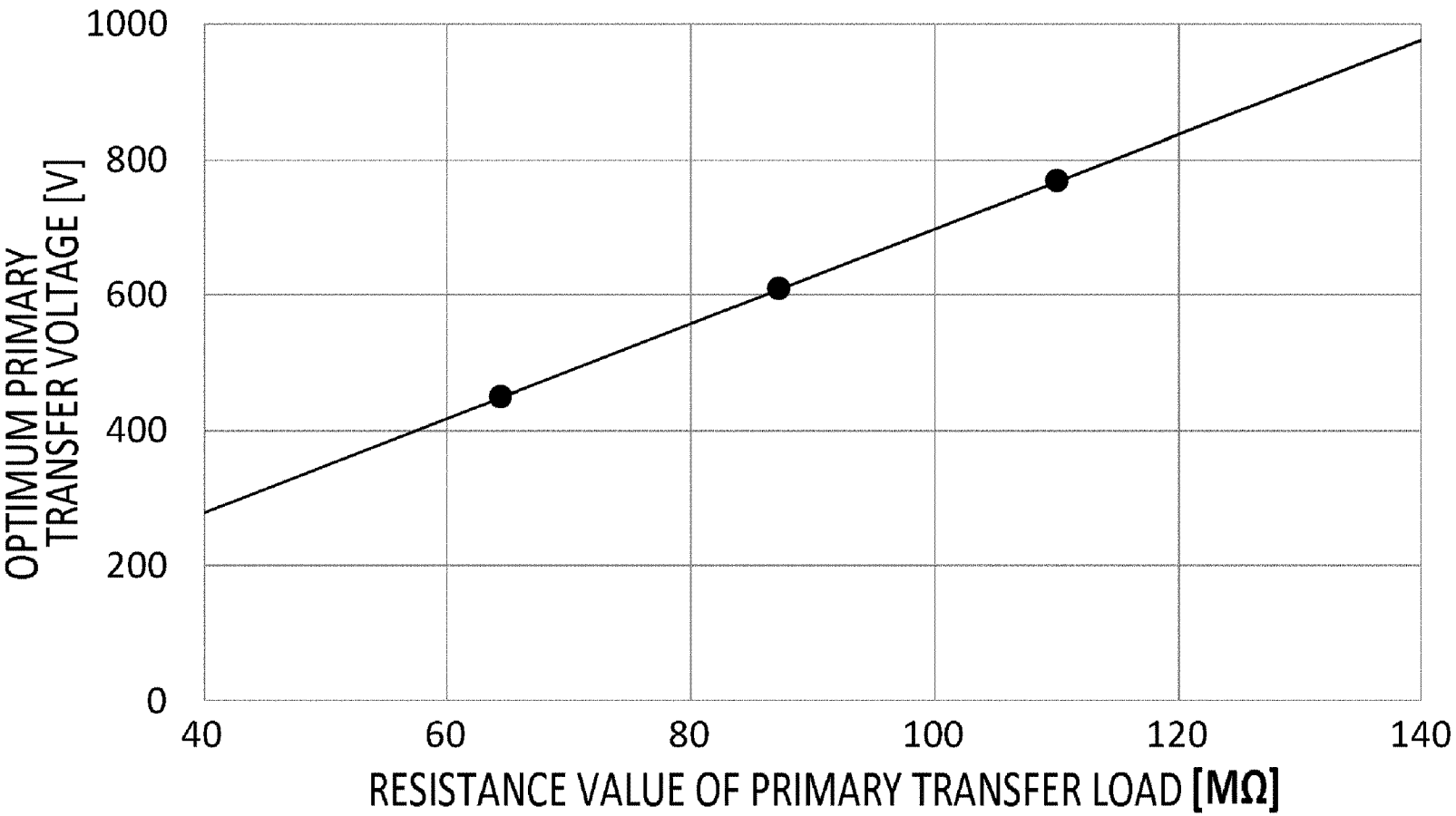
FIG. 15 is a diagram showing a relationship between a resistance value of a primary transfer load and an optimum primary transfer voltage in the third embodiment.

In FIG. 15, the optimum primary transfer voltage read from FIG. 14 is shown in a vertical axis, and the resistance value of the primary transfer load is shown in a horizontal axis. The resistance value of the primary transfer load includes the fluctuations of the resistance value of the intermediate transfer belt, the fluctuations of the resistance value of the primary transfer brush, or the like and fluctuates about ±26% at maximum. By the fluctuations of the resistance value of the primary transfer load, a curve shown in FIG. 14 also changes. In addition, the optimum primary transfer voltage fluctuates as shown in FIG. 15. The optimum primary transfer voltage becomes 610 V when the primary transfer load has a middle resistance value, 770 V when the primary transfer load has the highest resistance value, and 450 V when the primary transfer has the lowest resistance value.

In the control method of the comparative example, the primary transfer voltage to be applied is determined according to the primary transfer load having the middle resistance value, and a voltage of 610 V is applied as such. Therefore, the applied voltage is smaller by about 160 V than the voltage applied with respect to the primary transfer load having the highest resistance value, and larger by about 160 V than the voltage applied with respect to the primary transfer load having the lowest resistance value. On the other hand, in the control method of the embodiment, the resistance value of the primary transfer load is calculated to determine the applied voltage. Therefore, even when the primary transfer load has the highest or the lowest resistance value, the optimum primary transfer voltage may be applied.

According to the embodiment, an optimum primary transfer voltage may be applied even when the resistance value of a primary transfer load fluctuates as described above. Thus, excellent primary transferability may be ensured.

Fourth Embodiment

Figure 16:
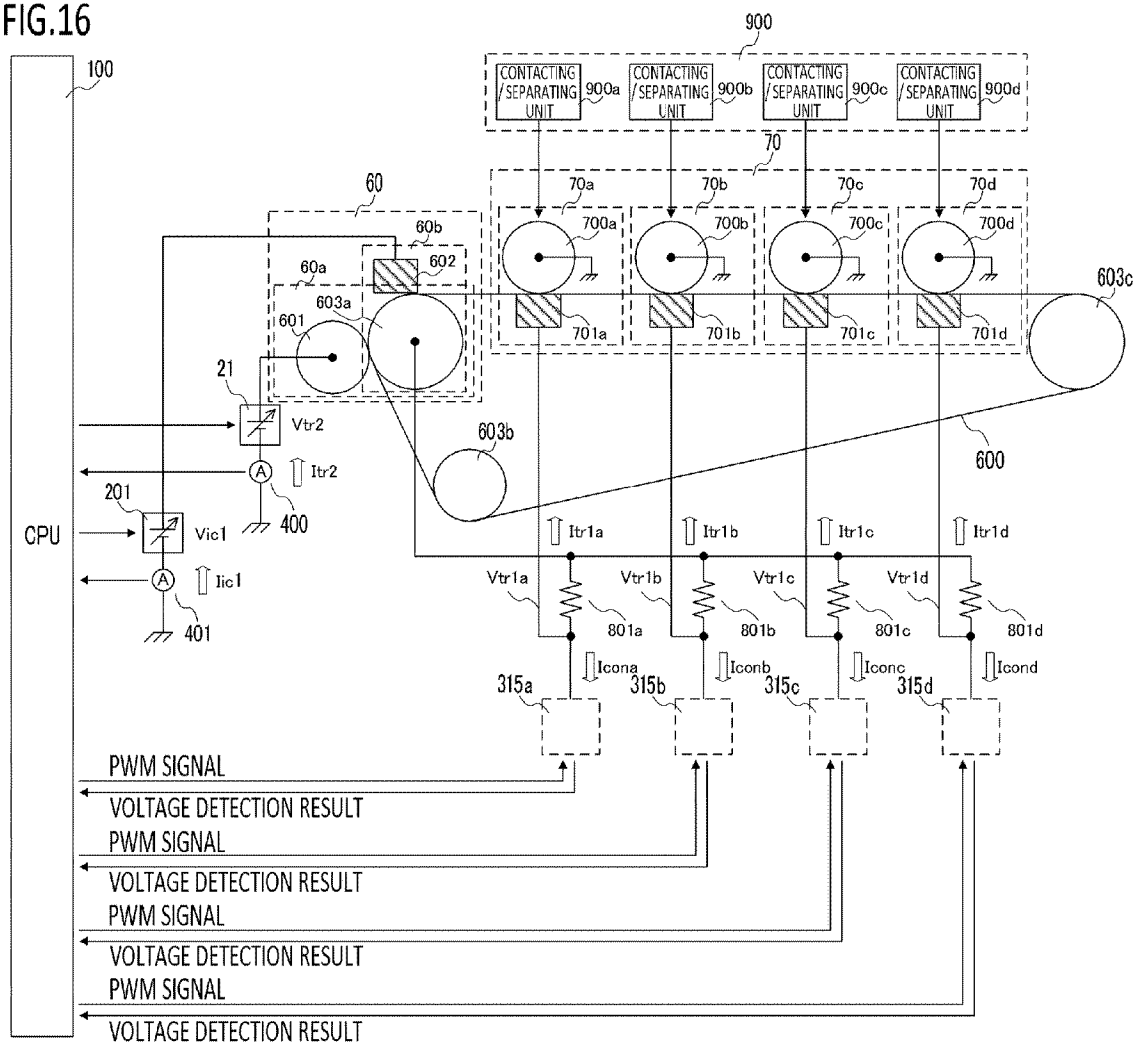
FIG. 16 is a configuration diagram of a transfer portion of an image forming apparatus according to a fourth embodiment.

FIG. 16 is a diagram for describing the transfer portion of an image forming apparatus according to a fourth embodiment. In FIG. 16, the same components as those of the third embodiment in FIG. 12 will be denoted by the same symbols, and their descriptions will be omitted. The embodiment shown in FIG. 16 is different from the third embodiment shown in FIG. 12 in that each of the image forming stations of a primary transfer portion has a current control circuit, voltage detection unit, and contacting/separating unit for causing a photosensitive drum to contact or separate from an intermediate transfer belt. On the other hand, the embodiment is the same as the third embodiment in that the resistance value of a primary transfer load is calculated from a current detection result obtained by detecting a current flowing through an upstream electric load and a voltage detection result obtained by detecting a voltage applied to a downstream electric load.

In the third embodiment shown in FIG. 12, the primary transfer voltage Vtr1 is supplied to the four image forming stations by one current control unit. Therefore, there is a likelihood that primary transferability fluctuates due to the fluctuations of the resistance value of a primary transfer load in each of the image forming stations. On the other hand, in the fourth embodiment shown in FIG. 16, current control circuits 315*a*, 315*b*, 315*c*, and 315*d* are provided for the respective image forming stations to adjust primary transfer voltages Vtr1*a*, Vtr1*b*, Vtr1*c*, and Vtr1*d* to eliminate the fluctuations of primary transferability for each of the image forming stations. Each of the current control circuits 315*a*, 315*b*, 315*c*, and 315*d* is the same as the current control circuit 315 of the third embodiment shown in FIG. 12. Resistors 801*a*, 801*b*, 801*c*, and 801*d* serving as voltage drop elements are provided to separate the primary transfer voltages for each of the stations.

In the image forming apparatus in FIG. 16, the relationship between a secondary transfer current Itr2, a cleaning current Iic1, and primary transfer currents Itr1*a*, Itr1*b*, Itr1*c*, and Itr1*d* flowing through the respective image forming stations is expressed by the following formula (8).

$$Itr2+Iic1=(Itr1a+\mathrm{Icon}a)+(Itr1b+\mathrm{Icon}b)+(Itr1c+\mathrm{Icon}c)+(Itr1d+\mathrm{Icon}d) \quad (8)$$

Icona, Iconb, Iconc, and Icond are control currents flowing through the current control circuits 315*a*, 315*b*, 315*c*, and 315*d* of the respective image forming stations.

In calculating the resistance value of a primary transfer load for each of the image forming stations, the control currents flowing through the current control circuits of all the image forming stations are set to be known, and photosensitive drums other than the photosensitive drum of an image forming station of which the resistance value of the primary transfer load is to be calculated are separated. This control is separately performed for all the four image forming stations with a time deviation for each of the image forming stations. Like the third embodiment, a condition for turning off a transistor is set in the embodiment as well. By setting the control currents Icona, Iconb, Iconc, and Icond at 0, a state in which the control currents are known is created.

In addition, the photosensitive drums of image forming stations other than an image forming station of which the resistance value is to be calculated are separated by the contacting/separating units 900 (900*a*, 900*b*, 900*c*, and/or 900*d*) to set currents flowing through the image forming stations other than the image forming station of which the resistance value is to be calculated at 0. For example, when the resistance value of an image forming station 70*a* is calculated, the photosensitive drums of image forming stations 70*b*, 70*c*, and 70*d* are separated to set Iconb, Iconc, and Icond at 0. At this time, the following formula (9) is obtained from the above formula (8).

$$Itr1a=Itr2+Iic1 \quad (9)$$

Thus, a resistance value Rtr1*a* of the primary transfer load of the image forming station 70*a* may be calculated by the following formula (10).

$$Rtr1a=Vtr1a/(Itr2+Iic1) \quad (10)$$

The above control is performed for the image forming stations 70*b*, 70*c*, and 70*d* with a time deviation, whereby resistance values Rtr1*a*, Rtr1*b*, Rtr1*c*, and Rtr1*d* of all the image forming stations may be calculated.

A CPU 100 has a table for optimum primary transfer voltages corresponding to the resistance values of calculated primary transfer loads and performs the constant voltage control of optimum primary transfer voltages Vtr1*a*, Vtr1*b*, Vtr1*c*, and Vtr1*d* corresponding to the resistance values of the primary transfer loads calculated in an image forming operation.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-153769, filed on Aug. 4, 2016, and No. 2017-26151, filed on Feb. 15, 2017, which are hereby incorporated by reference herein in their entirety.

What is claimed is:

1. An image forming apparatus comprising:

an image bearing member that bears a toner image;

an endless belt that rotates in contact with the image bearing member;

a current supply member that contacts the belt at a position different from a position, at which the image bearing member contacts the belt with respect to a rotating direction of the belt, and supplies a current to the belt;

a control portion that outputs a control signal;

a contact member that contacts the belt; and a voltage adjustment portion that has a voltage adjustment member connected to the contact member and that changes an amount of the current flowing from the current supply member to the voltage adjustment member via the belt according to the control signal input from the control portion, thereby changing a magnitude of a transfer potential at a part, at which the belt contacts the image bearing member.

2. The image forming apparatus according to claim 1, wherein the control signal is a PWM signal, and the voltage adjustment portion changes an amount of the current supplied from the current supply member to the belt according to a size of a duty ratio of the PWM signal input from the control portion.

3. The image forming apparatus according to claim 1, wherein the voltage adjustment portion has a transistor serving as the voltage adjustment member.

4. The image forming apparatus according to claim 1, further comprising:

a detection portion that detects temperature and humidity, wherein the control portion changes the control signal such that the transfer potential becomes lower as an absolute water amount acquired from the temperature and the humidity detected by the detection portion increases.

5. The image forming apparatus according to claim 1, further comprising:

an acquisition portion that acquires information on service life of the belt, wherein the control portion changes the control signal such that the transfer potential becomes higher as remaining service life of the belt acquired by the acquisition portion becomes shorter.

6. The image forming apparatus according to claim 5, wherein the information on the service life is acquired based on at least any of the number of times of an image forming operation, the number of total pixels of an image obtained by the image forming operation, and a rotation time of the belt.

7. The image forming apparatus according to claim 1, wherein the voltage adjustment portion is connected to the belt via a support member that supports an inner peripheral surface of the belt as the contact member.

8. The image forming apparatus according to claim 7, further comprising:

a voltage maintaining element connected between the support member and the voltage adjustment portion, wherein the transfer potential becomes a size of a potential obtained by overlapping a prescribed potential maintained by the voltage maintaining element and a potential variably adjusted by the voltage adjustment portion with each other.

9. The image forming apparatus according to claim 8, wherein the voltage maintaining element is a Zener diode.

10. The image forming apparatus according to claim 1, wherein the current supply member is a secondary transfer member that secondarily transfers the toner image from the belt onto a recording material with the current supplied to a part at which the secondary transfer member contacts the belt.

11. The image forming apparatus according to claim 1, further comprising:

a second current supply member that contacts the belt at a position different from positions at which the image bearing member and the current supply member contact the belt, wherein a current obtained by overlapping the current supplied to the belt by the current supply member and a current supplied to the belt by the second current supply member with each other flows through the part at which the belt contacts the image bearing member.

12. The image forming apparatus according to claim 11, wherein the second current supply member is a charging member that charges toner borne by the belt.

13. The image forming apparatus according to claim 1, wherein the current supply member is a charging member that charges toner borne by the belt.

14. The image forming apparatus according to claim 1, wherein the belt is an endless belt body having ionic conductivity.

15. The image forming apparatus according to claim 1, further comprising:

a current detection portion that detects an amount of the current flowing through the current supply member; and a voltage detection portion that detects a transfer voltage, wherein the contact member contacts the belt at a position opposing the current supply member via the belt, and the control portion controls the voltage adjustment portion such that a current amount of a control current flowing through the voltage adjustment member becomes a known current amount and acquires a first current amount, based on the known current amount and a current amount detected by the current detection portion, and controls the control signal, based on the first current amount and a value of the voltage detected by the voltage detection portion.

16. The image forming apparatus according to claim 15, wherein, with an electric load that ranges from the current supply member to the contact member via the belt being an upstream electric load, and with an electric load that ranges from the contact member to ground being a downstream electric load, the voltage detection portion detects a value of a voltage applied to the downstream electric load, and the first current amount includes an amount of a current flowing through the downstream electric load.

17. The image forming apparatus according to claim 16, wherein the control portion controls the voltage adjustment portion such that the current does not flow through the voltage adjustment member and acquires the amount of the current flowing through to the downstream electric load, with the current amount of the control current being zero.

18. The image forming apparatus according to claim 16, further comprising:

a second current supply member that contacts the belt at a position opposing the contact member via the belt and supplies a current to the belt, with the current supply member being a first current supply member, the position being different from positions at which the image bearing member and the first current supply member oppose the belt with respect to the rotating direction of the belt;

a second contact member that contacts the belt at a position opposing the image bearing member via the belt, with the contact member being a first contact member; and a second current detection portion that detects an amount of a current flowing through the upstream electric load that ranges from the second current supply member to the second contact member via the belt, with the current detection portion being a first current detection portion, wherein the control portion acquires the amount of the current flowing through the downstream electric load that ranges from the first contact member to the ground via the second contact member, based on the known current amount, the current amount detected by the first current detection portion, and the current amount detected by the second current detection portion.

19. The image forming apparatus according to claim 18, wherein the first current supply member is a secondary transfer member that secondarily transfers the toner image from the belt onto a recording material with a current flowing through a part at which the first current supply member contacts the belt.

20. The image forming apparatus according to claim 18, wherein the second current supply member is a charging member that charges toner borne by the belt.

21. The image forming apparatus according to claim 18, further comprising:

a plurality of the image bearing member; and a plurality of the second contact member corresponding to the plurality of the image bearing member.

22. The image forming apparatus according to claim 21, further comprising:

a plurality of voltage adjustment portions corresponding to the plurality of the image bearing members, wherein the plurality of the image bearing members are configured to be capable of separately contacting or separating from the belt, and the control portion acquires a resistance value of the downstream electric load that ranges from the first contact member to the ground via the second contact member opposing the image bearing member contacting the belt among the plurality of the second contact members.

23. The image forming apparatus according to claim 16, further comprising:

a voltage drop element connected between the upstream electric load and the voltage adjustment portion to be in series with the voltage adjustment portion.

24. The image forming apparatus according to claim 23, wherein the voltage drop element includes a Zener diode.

* * * * *